US009987542B2

(12) United States Patent
Coffman

(10) Patent No.: US 9,987,542 B2
(45) **Date of Patent: *Jun. 5, 2018**

(54) ENHANCED GOLF SIMULATION SYSTEM

(71) Applicant: VG BUYER, LLC, Greenwich, CT (US)

(72) Inventor: Sean Coffman, Beresford, SD (US)

(73) Assignee: VG Buyer, LLC, Greenwich, CT (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/644,929

(22) Filed: Mar. 11, 2015

(65) Prior Publication Data

US 2018/0093156 A1 Apr. 5, 2018

Related U.S. Application Data

(63) Continuation-in-part of application No. 14/302,767, filed on Jun. 12, 2014, now Pat. No. 9,308,429, which is a continuation-in-part of application No. 14/093,963, filed on Dec. 2, 2013, now Pat. No. 9,028,335, which is a continuation of application No. 13/917,896, filed on Jun. 14, 2013, now Pat. No. 8,616,988.

(60) Provisional application No. 62/106,027, filed on Jan. 21, 2015.

(51) Int. Cl.
*A63B 69/36* (2006.01)

(52) U.S. Cl.
CPC .... *A63B 69/3661* (2013.01); *A63B 2225/093* (2013.01)

(58) Field of Classification Search
USPC ..... 473/150, 157–163, 171, 278, 279
See application file for complete search history.

(56) References Cited

U.S. PATENT DOCUMENTS 1,612,291 A * 12/1926 Jackson ..... A63B 67/02 14/69.5
1,612,292 A 12/1926 Jackson
2,678,823 A 5/1954 Hugman
(Continued)

OTHER PUBLICATIONS

Matthew Ralphs; "Re-Configurable Pulling Green"; Thesis; 64 pages; Utah State University, Undergraduate Honors Theses, Paper 110, Logan, Utah; http://digitalcommons.usu.edu/honors/110.

*Primary Examiner* — Nini Legesse
(74) *Attorney, Agent, or Firm* — Procopio; Noel C. Gillespie

(57) ABSTRACT

A green simulation apparatus having a configurable upper surface with a changeable contour may comprise a covering forming the upper surface and a covering support assembly configured to support the covering. The support assembly may comprise a plurality of movable positioning elements having the covering resting thereon and positioned in an array extending in a reference plane and movable along axes extending substantially perpendicular to the reference plane. The support assembly may comprise a movement actuator configured to move at least one of the positioning elements independently of other positioning elements in the array. The plurality of positioning elements may include active positioning elements and passive positioning elements, with the active positioning elements being associated with a movement actuator and the passive positioning elements not being associated with a movement actuator.

17 Claims, 38 Drawing Sheets

(56) References Cited

U.S. PATENT DOCUMENTS

| | | | | | |
|---|---|---|---|---|---|
| 3,170,694 | A | | 2/1965 | Dolce | |
| 3,595,581 | A | * | 7/1971 | Anderson | A63B 67/02 14/28 |
| 3,601,406 | A | | 8/1971 | Giusti | |
| 3,658,343 | A | | 4/1972 | Rogers | |
| 3,892,412 | A | | 7/1975 | Koo | |
| 4,009,881 | A | * | 3/1977 | Potter, III | A63F 7/3603 273/108.1 |
| 4,160,942 | A | | 7/1979 | Lynch | |
| 4,222,568 | A | | 9/1980 | Russo | |
| 4,611,809 | A | | 9/1986 | Gettelfinger | |
| 4,749,169 | A | | 6/1988 | Pickles | |
| 4,790,538 | A | | 12/1988 | Gettelfinger | |
| 4,943,034 | A | | 7/1990 | Wagnon | |
| 5,031,916 | A | | 7/1991 | Boswell | |
| 5,056,791 | A | | 10/1991 | Poillon | |
| 5,087,045 | A | | 2/1992 | Kim | |
| 5,094,569 | A | | 3/1992 | Fleming | |
| 5,100,145 | A | | 3/1992 | Kim | |
| 5,172,914 | A | | 12/1992 | Primerano | |
| 5,221,082 | A | | 6/1993 | Curshod | |
| 5,333,874 | A | | 8/1994 | Arnold | |
| 5,390,926 | A | | 2/1995 | Hanson | |
| 5,390,927 | A | | 2/1995 | Angelos | |
| 5,657,964 | A | | 8/1997 | Yoshida | |
| 5,855,522 | A | | 1/1999 | Bevan | |
| 5,950,990 | A | | 9/1999 | Castillo | |
| 6,056,645 | A | | 5/2000 | Servatius | |
| 6,179,721 | B1 | | 1/2001 | Bevan | |
| 6,338,682 | B1 | | 1/2002 | Torchia | |
| 6,695,289 | B1 | | 2/2004 | Mickael | |
| 6,746,338 | B1 | | 6/2004 | Keaton | |
| 6,769,993 | B1 | | 8/2004 | Lasalandra | |
| 6,805,638 | B2 | | 10/2004 | Chang | |
| 6,913,541 | B2 | | 7/2005 | Chen | |
| 6,964,615 | B2 | | 11/2005 | Lee | |
| 8,616,988 | B1 | * | 12/2013 | Coffman | A63B 69/36 473/150 |
| 9,028,335 | B1 | | 5/2015 | Coffman | |
| 9,308,429 | B1 | * | 4/2016 | Coffman | A63B 69/3661 |
| 9,731,183 | B2 | | 8/2017 | Coffman | |
| 2001/0003103 | A1 | | 6/2001 | Bevan | |
| 2005/0153788 | A1 | | 7/2005 | Saldana | |
| 2011/0192096 | A1 | | 8/2011 | Koberinski | |
| 2014/0073445 | A1 | | 3/2014 | Flammer | |
| 2015/0231479 | A1 | | 8/2015 | Coffman | |

* cited by examiner

ENHANCED GOLF SIMULATION SYSTEM

REFERENCE TO RELATED APPLICATION

This application claims the priority of U.S. Provisional Patent Application No. 62/106,027, filed Jan. 21, 2015, and is a continuation-in-part of U.S. patent application Ser. No. 14/302,767, filed Jun. 12, 2014, which is a continuation-in-part of U.S. patent application Ser. No. 14/093,963, filed Dec. 2, 2013, which is a continuation of U.S. patent application Ser. No. 13/917,896, filed Jun. 14, 2013, which was issued as U.S. Pat. No. 8,616,988, all of which are hereby incorporated by reference in their entireties.

BACKGROUND

Field

The present disclosure relates to golf simulation apparatus and more particularly pertains to a new golf simulation system for providing a more realistic and challenging contouring of the surface of a simulated green surface.

SUMMARY

In one aspect, the present disclosure relates to an apparatus having a configurable upper surface with a changeable contour. The apparatus may comprise a plurality of movable surface elements positioned in a close array and each forming portions of the upper surface. Each of the surface elements has a top surface forming a respective portion of the upper surface, and each of the surfaces elements may be elongated with a longitudinal axis. The top surface of a said surface element has a perimeter and the perimeters of adjacent surface elements may define a gap therebetween. The perimeters may be configured such that the gap between the perimeters is substantially uniform. The surface elements may be movable in the longitudinal direction to adjust the position of the top surface. The surface elements may have a neutral position, and the top surfaces of surface elements in the neutral position may define a reference plane. The surface element may have a plurality of raised positions in which the top surface is located vertically higher than the reference plane.

In another aspect, the present disclosure relates to a golf simulation system may comprise a screen with a projection surface, a ball path analysis device configured to predict a path of a ball struck by a club of a user, and a green simulation apparatus having a configurable upper surface with a changeable contour. The apparatus may comprise a plurality of movable surface elements positioned in a close array and each forming portions of the upper surface. Each of the surface elements has a top surface forming a respective portion of the upper surface, and each of the surfaces elements may be elongated with a longitudinal axis. The top surface of a said surface element has a perimeter and the perimeters of adjacent surface elements may define a gap therebetween. The perimeters may be configured such that the gap between the perimeters is substantially uniform. The surface elements may be movable in the longitudinal direction to adjust the position of the top surface. The surface elements may have a neutral position, and the top surfaces of surface elements in the neutral position may define a reference plane. The surface element may have a plurality of raised positions in which the top surface is located vertically higher than the reference plane.

In yet another aspect, the disclosure relates to a green simulation apparatus having a configurable upper surface with a changeable contour. The apparatus may comprise a covering forming the upper surface and a covering support assembly configured to support the covering. The support assembly may comprise a plurality of movable positioning elements having the covering resting thereon, with the plurality of positioning elements being positioned in an array extending in a reference plane and the positioning elements being movable along axes extending substantially perpendicular to the reference plane. The positioning elements may be elongated with a longitudinal axis. The support assembly may also comprise a movement actuator configured to move at least one of the positioning elements independently of other positioning elements in the array. The plurality of positioning elements may include active positioning elements and passive positioning elements, and the active positioning elements may be associated with a said movement actuator and the passive positioning elements may not be associated with a said movement actuator.

In still another aspect, the disclosure relates to a green simulation apparatus having a configurable upper surface with a changeable contour. The apparatus may comprise a covering forming the upper surface and a covering support assembly configured to support the covering. The support assembly may comprise a plurality of movable positioning elements having the covering resting thereon, with the plurality of positioning elements being positioned in an array extending in a reference plane and the positioning elements being movable along axes extending substantially perpendicular to the reference plane. The positioning elements may be elongated with a longitudinal axis. The support assembly may also comprise a movement actuator configured to move at least one of the positioning elements independently of other positioning elements in the array. The array of positioning elements may include a central region and at least one peripheral region positioned peripheral to the central region, with a density of positioning elements in the reference plane being greater in the central region than in the at least one peripheral region.

In still yet another aspect, the disclosure relates to a green simulation apparatus having a configurable upper surface with a changeable contour. The apparatus may comprise a covering forming the upper surface and a covering support assembly configured to support the covering. The support assembly may comprise a plurality of movable positioning elements having the covering resting thereon, with the plurality of positioning elements being positioned in an array extending in a reference plane and the positioning elements being movable along axes extending substantially perpendicular to the reference plane. The positioning elements may be elongated with a longitudinal axis. The support assembly may also comprise a movement actuator configured to move at least one of the positioning elements independently of other positioning elements in the array. The covering support assembly may comprise a plurality of modules each including at least one positioning element, with the modules being removably connected to each other to form the array of positioning elements.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
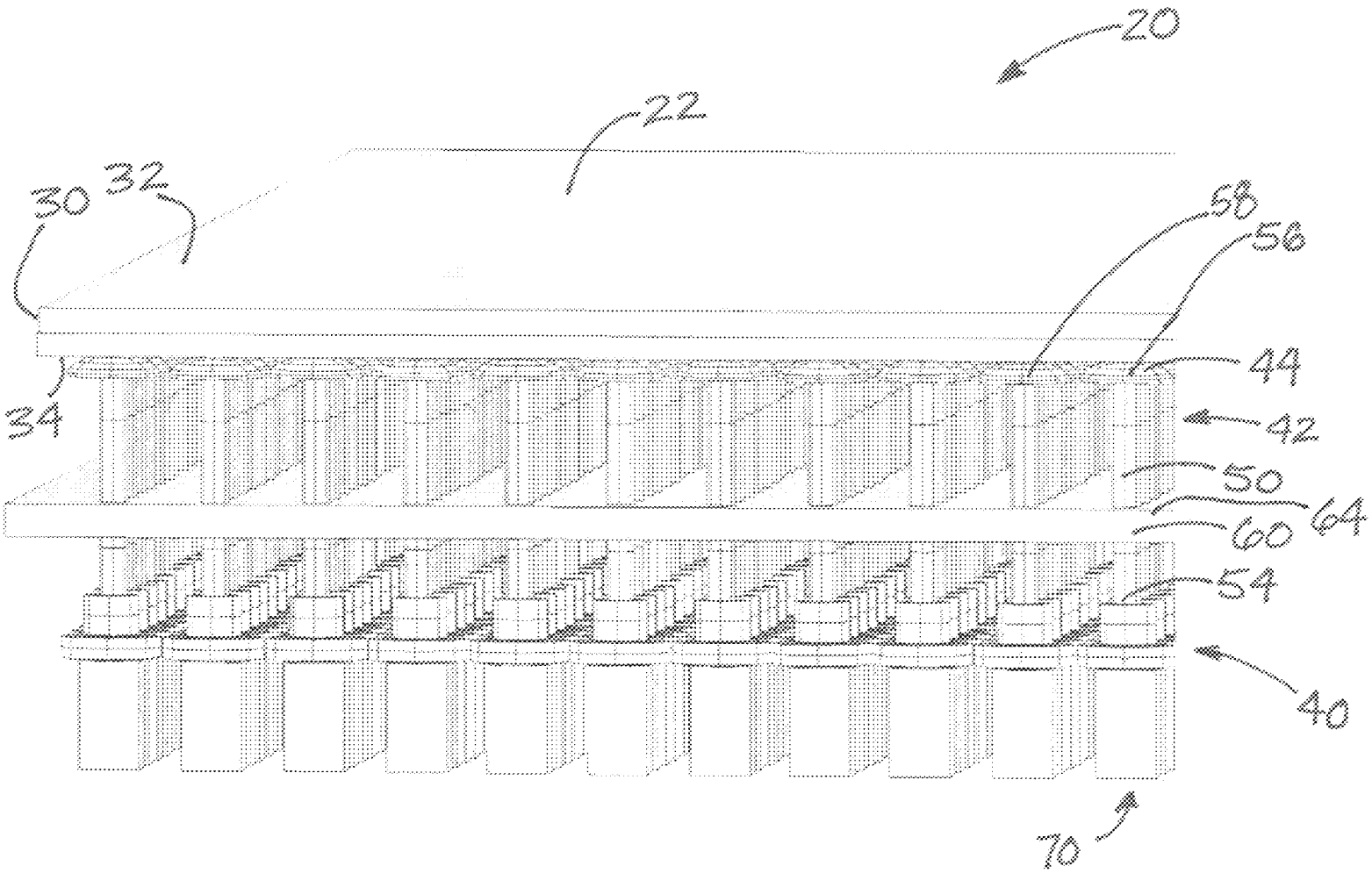
FIG. 1 is a schematic perspective view of the green simulation apparatus of a new golf simulation system according to the present disclosure, with the covering in a base condition and the support assembly in a neutral position.

With reference now to the drawings, and in particular to FIGS. 1 through 39 thereof, a new golf simulation system embodying the principles and concepts of the disclosed subject matter will be described.

Applicant has recognized the value of devices that provide a virtual experience that is close to the actual experience. One example is a golf simulation system that allows the user to practice his or her golf swing in a controlled environment that provides a screen on which an image of a golf course fairway is projected for the purpose of the user lining up a shot and taking the shot, with the system providing some indication of the movement of the ball after the swing has been taken and the ball has been struck. Typically these simulators utilize a path of simulated turf large enough only for the user to stand and address the ball in a normal golf stance.

Applicant has also recognized that the value of such conventional simulators for short game practice, especially putting, is very limited. Typically, putting practice has been conducted on the floor of a room or platform which presents a flat, level, and not very realistic environment for practice. Golf course greens are typically not completely flat and level, particularly if the course is intended to be challenging to the player. Applicant has developed a system that may be used to realistically simulate golf greens with a variety of changeable contours to provide a more realistic and challenging practice experience, and which may be used with more conventional golf simulators which only attempt to simulate the long game.

Broadly, the aspects of the disclosure may be used to contour a surface such as a surface located on a support or platform in a manner that is easily and quickly changeable from one contour to another contour. The contouring may be produced and reproduced from contour data that has been generated from actual landscapes or may be created with no real antecedent landscape basis for the contour.

In one aspect of the development, a golf simulation system 10 comprises a screen 12 that may have a projection surface 14 onto which various golf course representations may be projected. The projection surface 14 of the screen may be substantially vertically oriented, and may be curved to extend about the user to some degree. The system 10 may also include a ball path analysis device 16 that uses various parameters such as club path, club speed, ball spin, etc. to determine a path for movement of the image of a simulated ball on the projection screen. The particular technology used to determine ball path and other aspects of the long game is not critical to the system and is known to those skilled in the art and will not be further discussed here.

Another aspect of the disclosure is a green simulation apparatus 20 that may be used with the aforementioned elements of the system 10. Significantly, the green simulation apparatus 20 has a configurable upper surface 22 that is moveable to provide a changeable contour. The configurable upper surface 22 may have a periphery 24, and the periphery may have opposite lateral sides 26, 27 and opposite ends 28, 29. In some embodiments, the periphery 24 of the upper surface may be surrounded by a frame having a stationary upper surface.

In general, the apparatus may include a covering 30 that may extend between the sides 26, 27 and ends 28, 29 and a covering support assembly 40 that supports the cover and also causes the contouring of the covering. The covering may be continuous between the sides and ends, or may comprise pieces that are mounted on one or more of the movable positioning elements 42 of the support assembly 40.

The covering 30 may form the upper surface 22 of the apparatus 20. The covering 30 may have a base condition (see FIG. 1) in which the upper surface 22 has a substantially planar or flat configuration and may also be level, which may represent a flat and level green surface. The covering may also have a contoured condition (see FIG. 2) in which the upper surface has a contoured configuration including portions of the surface that slope with peaks or ridges and valleys to simulate a green surface without an entirely flat and level orientation.

The covering 30 may have an upwardly-oriented top face 32 which forms the upper surface 22. The top face may be substantially continuous in character between the sides 26, 27 and ends 28, 29 of the periphery. The top face may also be configured in a manner that simulates the surface of a golf green, such as by the inclusion of a simulated turf material, although this is not critical to the system 10. The covering 30 may also have a bottom face positioned opposite of the top face and oriented downwardly.

Significantly, the covering 30 may be flexible, and may also be stretchable. The material forming the covering may be relatively incapable of supporting the weight of a user absent the covering support assembly described below. Materials having elastomeric properties may be highly suitable.

The covering support assembly 40 may support the covering in the various conditions, such as the base condition and the contoured condition. As the covering may not have any natural shape, or only a flat shape, the support assembly may form contours in the upper surface of the covering by varying the vertical level of support provided to different portions of the covering.

The support assembly 40 may comprise a plurality of movable positioning elements 42 that have the covering resting thereon such that the elements may control the vertical position of the portion of the covering that is located above the element. The plurality of positioning elements may be positioned in an array, and the array may have each of the positioning elements 42 positioned in a first line and a second line. In some embodiments, the first and second lines may be substantially perpendicular to each other (see FIG. 3), and in other embodiments the first and second lines may be at an oblique angle with respect to each other (see FIG. 7).

The positioning elements 42 may each have an upper end 44 for contacting a portion of the covering for moving the covering in a generally upward and downward direction. The positioning elements 42 may be substantially vertically movable to adjust the position of the upper end and thereby the position of the portion of the covering 30 being contacted by the upper end 44. The positioning elements 42 may be elongated in shape with a longitudinal axis 46, which may be substantially vertically oriented. The upper ends 44 may be moveable with respect to a reference plane, represented by reference number 48 in FIG. 5. The reference plane 48 may be defined by the upper ends 44 of the positioning elements when those elements are in a neutral position (see FIG. 5). The neutral position may be the lowermost positioning of the vertical travel of the positioning elements, but this is not required. The base condition of the covering 30 may generally correspond with the positioning elements 42 being in the neutral position. The positioning elements 42 may have a plurality of raised positions that are located vertically higher than the neutral position, and in some embodiments the positions of the elements, and the upper ends thereof, may be infinitely variable between the neutral position and a position of maximum vertical elevation of the upper end. The vertical positions of a positioning element may generally be independent of the other positioning elements. Suitable ranges of the distance of vertical movement may vary from 0 inches to approximately 24 inches, although greater or lesser ranges may be utilized, including ranges of 0 inches to 48 inches, 72 inches or even more. In some embodiments, a range of movement of 0 inches to approximately 12 inches may be employed.

In the illustrative embodiments, each positioning element 42 may comprise a pin 50 which has a top end 52 and a bottom end 54, and the pin may have a length between the top and bottom ends. The pin may have a maximum width which may be measured perpendicular to the longitudinal axis 46 of the element 42. In some of the most preferred embodiments, the outer surface of the pin may be substantially cylindrical in shape, although cross sectional shapes other than circular may be employed, particularly where resistance to rotation of the pin is desired.

Each positioning element 42 may also comprise a head 56 that is mounted on the pin 50. The head may be located on the top end 52 of the pin, and the head may define at least a portion of the upper end 44 of the positioning element. In some of the most preferred embodiments, the head 56 of a positioning element is unconnected to the heads of the adjacent positioning elements such that the positioning elements are able to move substantially independently of each other, although attachment to the covering (if employed) may produce some degree of constraint. In some of the most preferred embodiments, the head may have a substantially circular perimeter shape when viewed from above, any rounded shape may be employed, including oval shapes. Other perimeter shapes, including polygonal shapes when viewed from above may also be used.

The head 56 may have a top surface 58, and in some embodiments the top surface has a convex shape which may be advantageous, and may give the overall element a general mushroom-shape. The convexity of the top surface is not critical, as the top surface may also, for example, be substantially flat. The head 56 may have a maximum width which may be measured perpendicular to the longitudinal axis 46 of the element 42. The maximum width of the head may be uniform among all of the elements, although variation in dimension may be employed. The maximum width of the head may be greater than the maximum width of the pin such that the head is enlarged in width with respect to the pin, and presents a broader top surface than would the top end of the pin alone. The range of maximum widths for the heads may vary, and may range from approximately ¼ inch to approximately 6 inches which is believed to provide the greatest variability in the contour of the upper surface of the covering, although larger head sizes may be effectively employed as well.

In the array of positioning elements, the head 56 of one positioning element may be spaced from the head of an adjacent positioning element such that there is some separation of the heads, which may be advantageous but is not critical. A closest distance of the spacing between the adjacent heads may be about equal to or somewhat less than the maximum width of the head. The size of the maximum width of the head 56 and the spacing distance between the heads may be varied independently of each other to provide a desirable degree of contourability while still a suitable degree of support for the covering and a user standing on the covering. The spacing distance between heads may range from approximately 1/32 inch to approximately 12 inches, although spacings greater than these may be employed.

In some embodiments, the covering 30 may be fixed or attached to some or all of the positioning elements 42 to cause the portion of the covering above an element 42 to move with the movement of the element 42. The covering may be secured to the element 42, such as the top surface 58 of the head 56, in any suitable manner, such as by bonding (using, for example, an adhesive) or by mechanical fastening. Attachment of the covering to some of, or all of, the heads may constrain the movement of adjacent positioning elements to some degree as the covering may not be able to conform to substantial differences in vertical elevation between adjacent positioning elements. The relative flexibility and stretchability or elasticity of the material forming the covering may have an effect on the maximum difference in vertical elevation between adjacent elements 42. In some embodiments, the covering 30 may not be physically attached to some or all of the positioning elements, and the weight of the covering may be sufficient to keep the portion of the covering above an element 42 in close proximity to, if not contact with, the top surface 58 of the head 56.

The support assembly 40 may further include a guide 60 that is configured to guide the positioning elements 42 as the elements move. In some embodiments, the guide 60 has a guide aperture 62 for receiving each of the positioning elements. The positioning element 42 may be movable, and in some cases slidable, through the guide aperture 62. The guide aperture 62 may have a substantially vertical axis, and the aperture may be shaped and sized for a somewhat snug relationship with the pin to facilitate vertical movement without undue lateral movement. The guide 60 may have a plurality of the guide apertures, and the apertures may be substantially uniformly spaced from adjacent guide apertures formed in the guide. In the illustrative embodiments, the guide 60 may comprise at least one guide plate 64 with the guide apertures being formed in the plate 64. Other suitable configurations of the guide may be employed, such as, for example, multiple plates in a substantially parallel relationship, or a plurality of sleeves that each receive the pin of one of the elements.

The support assembly 40 may also comprise a movement actuator 70 that is configured to move at least one of the positioning elements 42. In some embodiments, one of the movement actuators 70 acts on each positioning element such that each positioning element is movable independently of other positioning elements. The movement actuator 70 may be positioned below the reference plane, and may be located below the guide 60. The movement actuator 70 may act on the bottom end 54 of the pin 50, or a bottom portion of the pin. The movement actuator 70 may be any suitable actuator that is capable of moving a pin vertically. Examples of suitable technology may employ pneumatics, hydraulics, magnetics, or mechanical action. Structures employing these technologies include, for example, piston and cylinder structures and linear actuators. The activation of the movement actuators may be controlled manually by a user, or may be controlled by a computerized system that controls the movement actuators automatically to produce a contouring that has been programmed into the system.

A golf hole or cup may be provided for the apparatus 20 in various ways. In some embodiments, the cup may be formed by a depression in the upper surface of the covering by dropping the position of the movable positioning elements at the desired location of the cup. In some embodiments, a hole may be formed in the covering (optionally with a cup extending downwardly therefrom) at a location that is relatively fixed on the upper surface, and the upper surface may thus be contoured around the hole and cup.

Using the disclosed green simulation apparatus, the user surface may be contoured in a manner that is able to produce an area of the upper surface that is raised to a vertical level that is relatively higher than areas of the upper surface that surround the raised area. This differentiates the apparatus of the disclosure from other apparatus that simply tilt the upper surface, or form a depressed "valley" between raised "ridges." While the disclosed apparatus is capable of forming these relatively simpler types of contours in the upper surface, it is not limited to them and is also capable of forming more complex contours such as the aforementioned raised areas of the upper surface surrounded depressed areas that can more accurately represent real world green contours. Further, the contouring of the upper surface may be controlled, through actuation of the movement actuators in an individual manner, by a computerized system that may replicate the contours of greens of actual golf courses.

In some embodiments, the movable positioning elements may be formed of structures that include a female cylinder 76 or sleeve that includes the top end of the element, and defines a channel into which extends a male post 78 forming the bottom end of the element. In some embodiments (see FIG. 10), the exterior surface of the post 78 and interior surface of the channel in the cylinder 76 may be complementarily threaded so that the threads engage. The post may be mounted to permit rotation about a vertical axis, and the post may be rotated to cause raising and lowering of the sleeve, and the top end located thereon. The post may be rotated by a motor or by any suitable mechanical, hydraulic, pneumatic, or other, means. The motor may be operated or controlled to raise or lower the top end and the portion of the covering located above the positioning element. Optionally, other means may be employed to cause the cylinder to move with respect to the post.

In some further embodiments, the moveable positioning elements may comprise pins that are relatively free floating (within extreme limits that have lower ends that are exposed to contact a contoured substrate that correlates in some manner to the desired contour of the upper surface of the covering. The substrate may have a contoured upper face that is positioned below the lower ends of the pins, and movement of the substrate upwardly to contact the lower ends of the pins tends to raise the pins to a degree that varies with the contour of the upper face at the location that the lower end contacts the face. The pins may thus telegraph the contour of the upper face of the substrate to the covering, and the upper surface of the covering.

Figure 9:
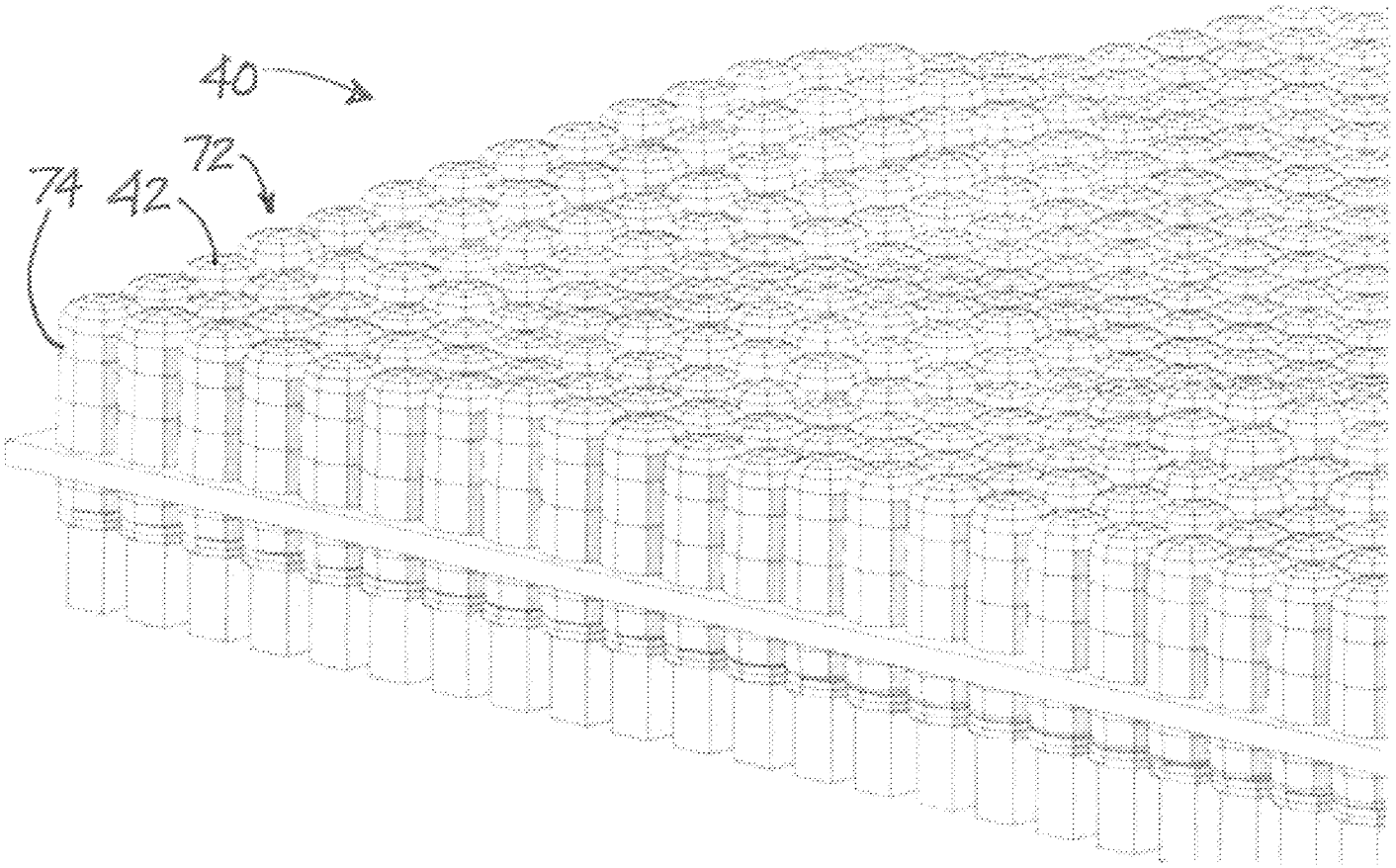
FIG. 9 is a schematic perspective view of an embodiment of the support assembly with the covering removed to show detail of the positioning elements, which defined a plurality of chambers for supporting the covering.
Figure 10:
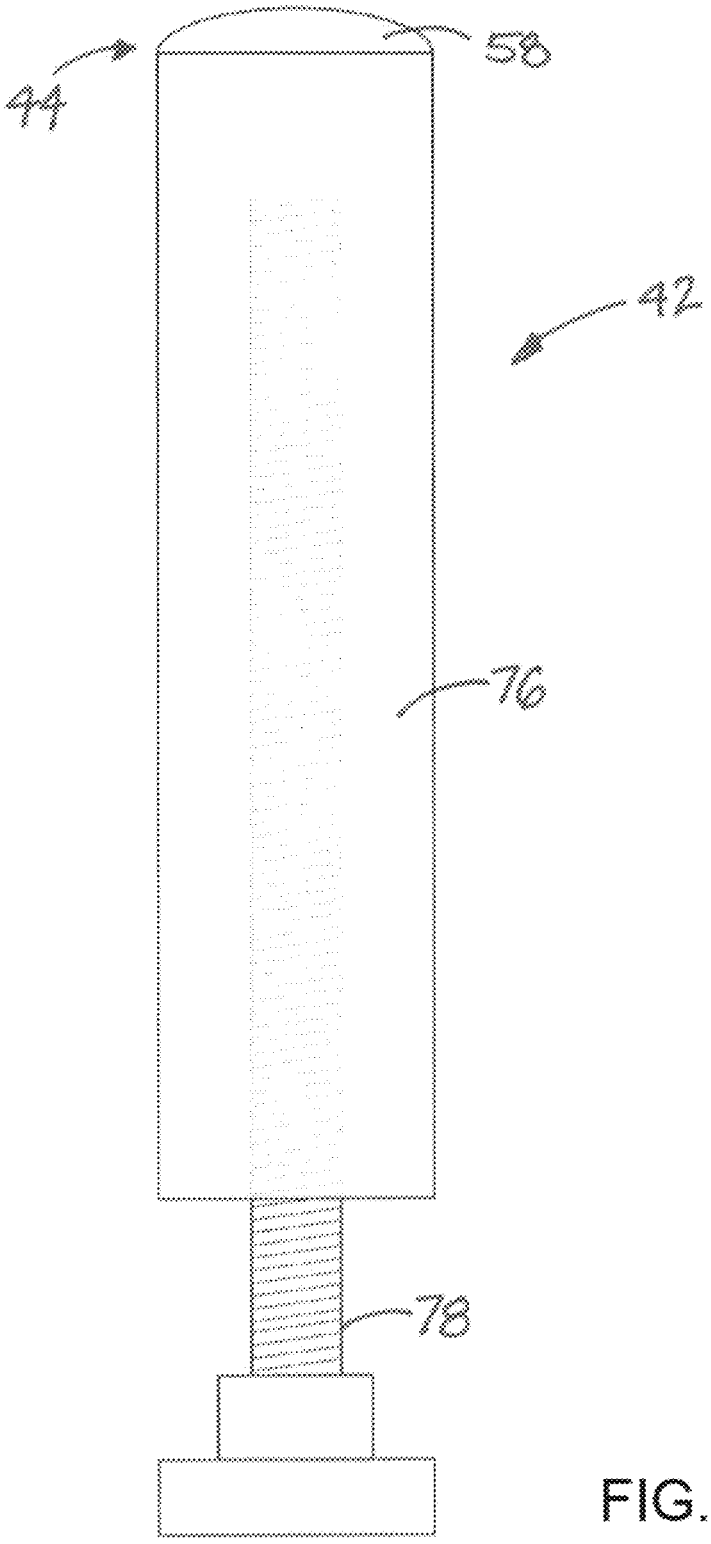
FIG. 10 is a schematic side view of one embodiment of a positioning element utilizing a cylinder and post arrangement, according to an illustrative embodiment.
Figure 11:
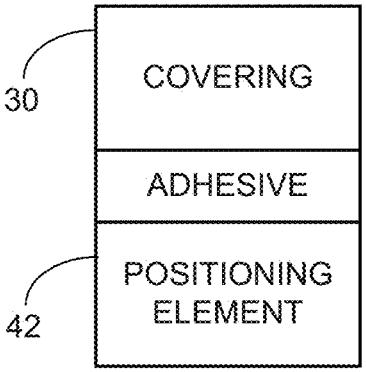
FIG. 11 is a schematic diagram of an illustrative relationship between the covering and one of the positioning elements.
Figure 12:
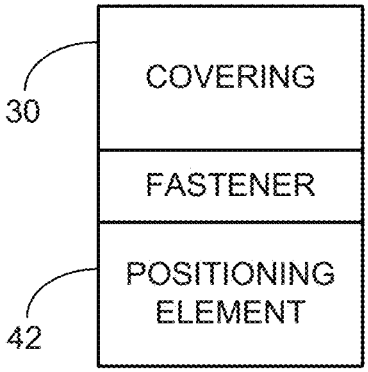
FIG. 12 is a schematic diagram of another illustrative relationship between the covering and one of the positioning elements.
Figure 13:
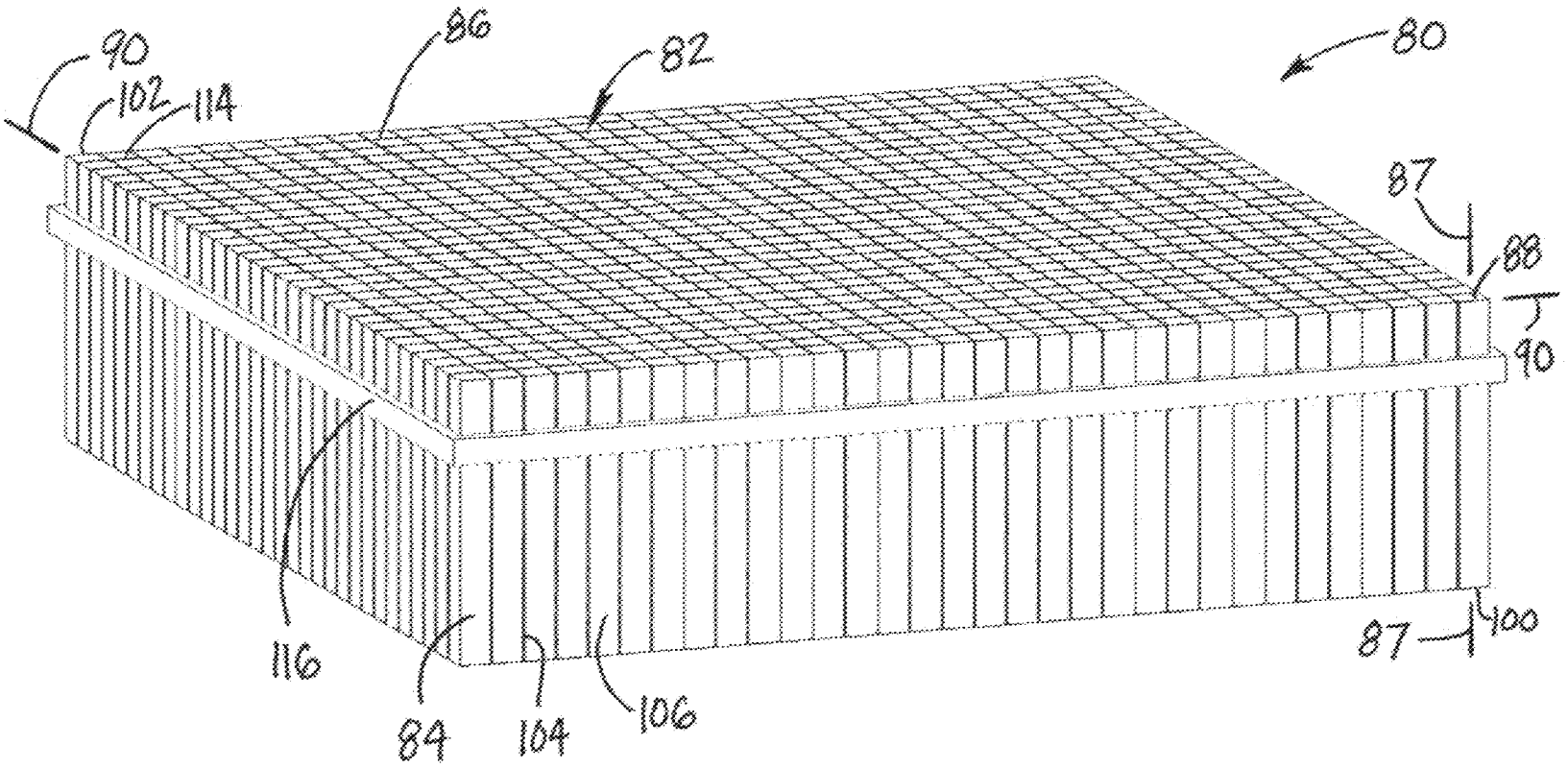
FIG. 13 is a schematic perspective view of an embodiment of a green simulation apparatus according to the present disclosure, showing surface elements with top surfaces having a square perimeter shape in a neutral position.
Figure 14:
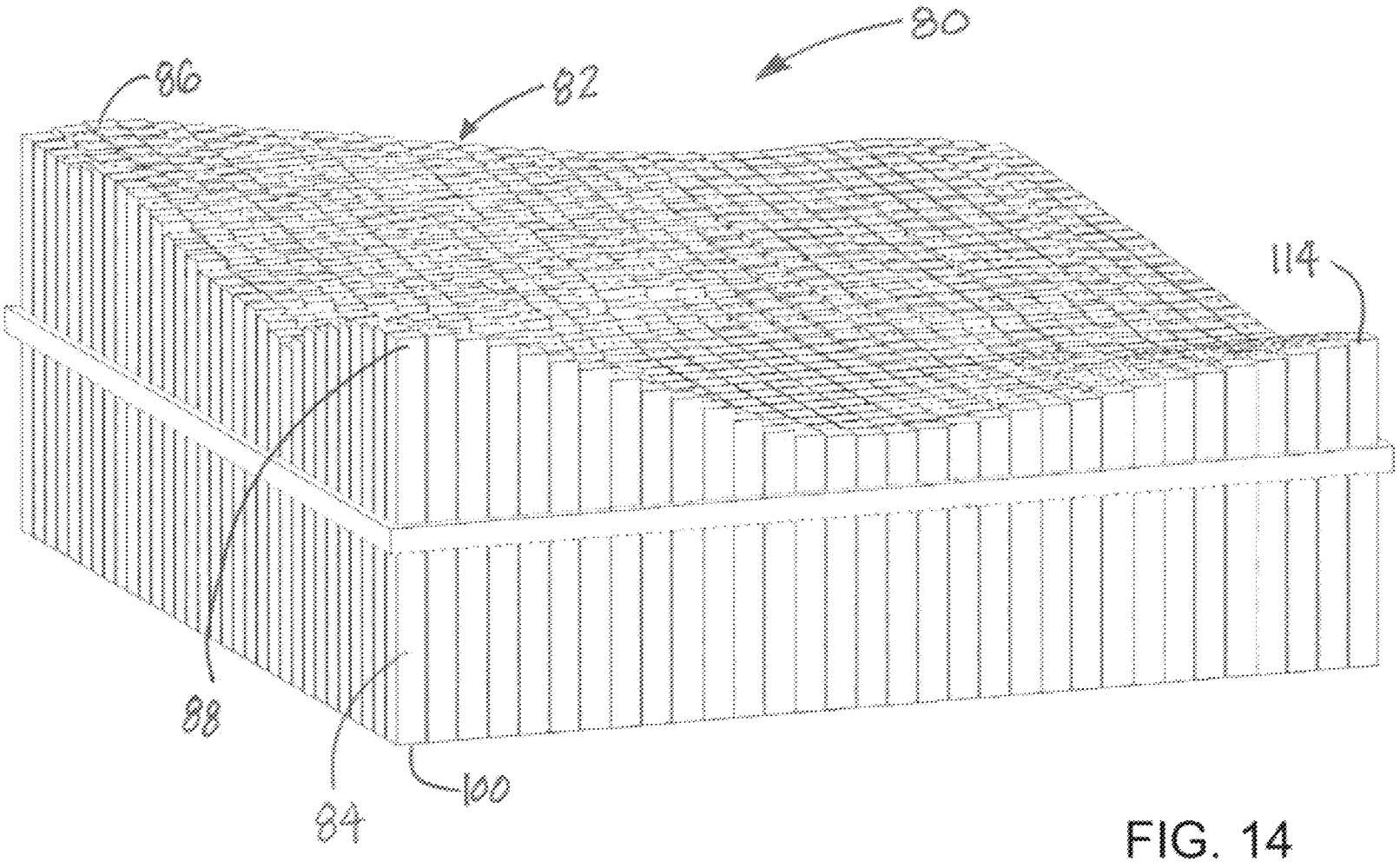
FIG. 14 is a schematic perspective view of the embodiment of a green simulation apparatus shown in FIG. 13, showing surface elements with top surfaces having a square perimeter shape in a raised position.
Figure 15:
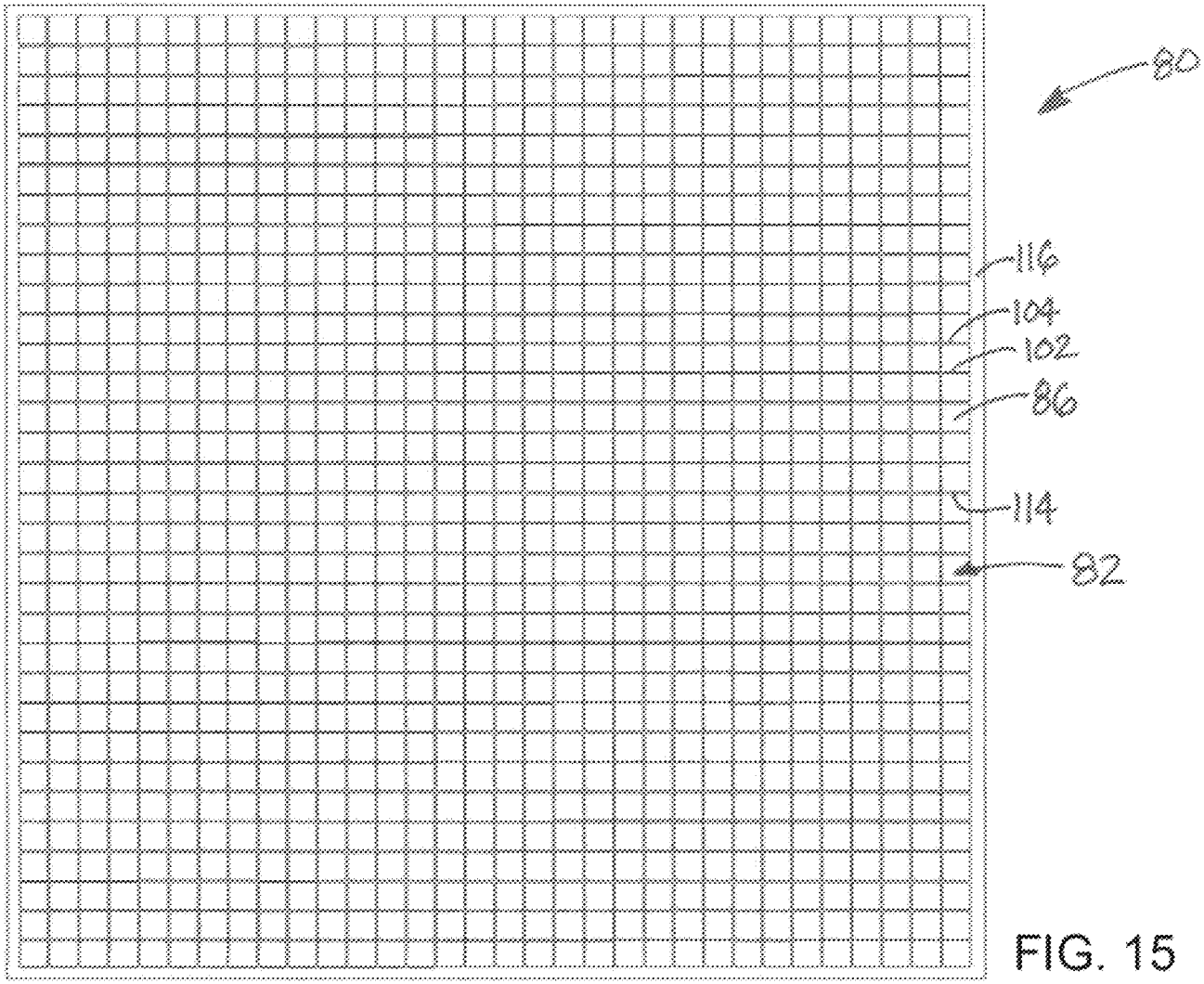
FIG. 15 is a schematic top view of the embodiment of a green simulation apparatus shown in FIG. 13.
Figure 16:
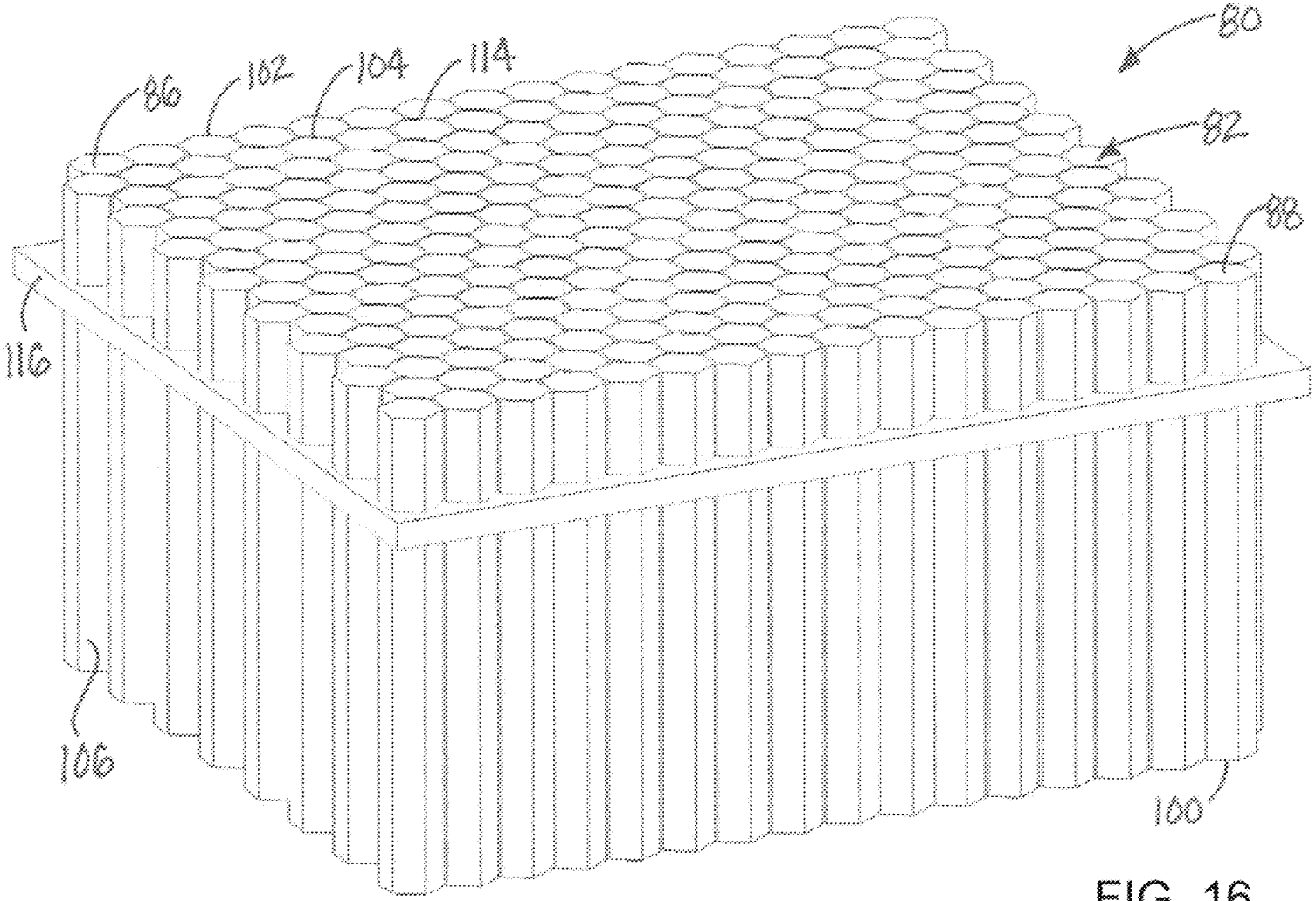
FIG. 16 is a schematic perspective view of an embodiment of a green simulation apparatus according to the present disclosure, showing surface elements with top surfaces having a hexagonal perimeter shape in a neutral position.
Figure 17:
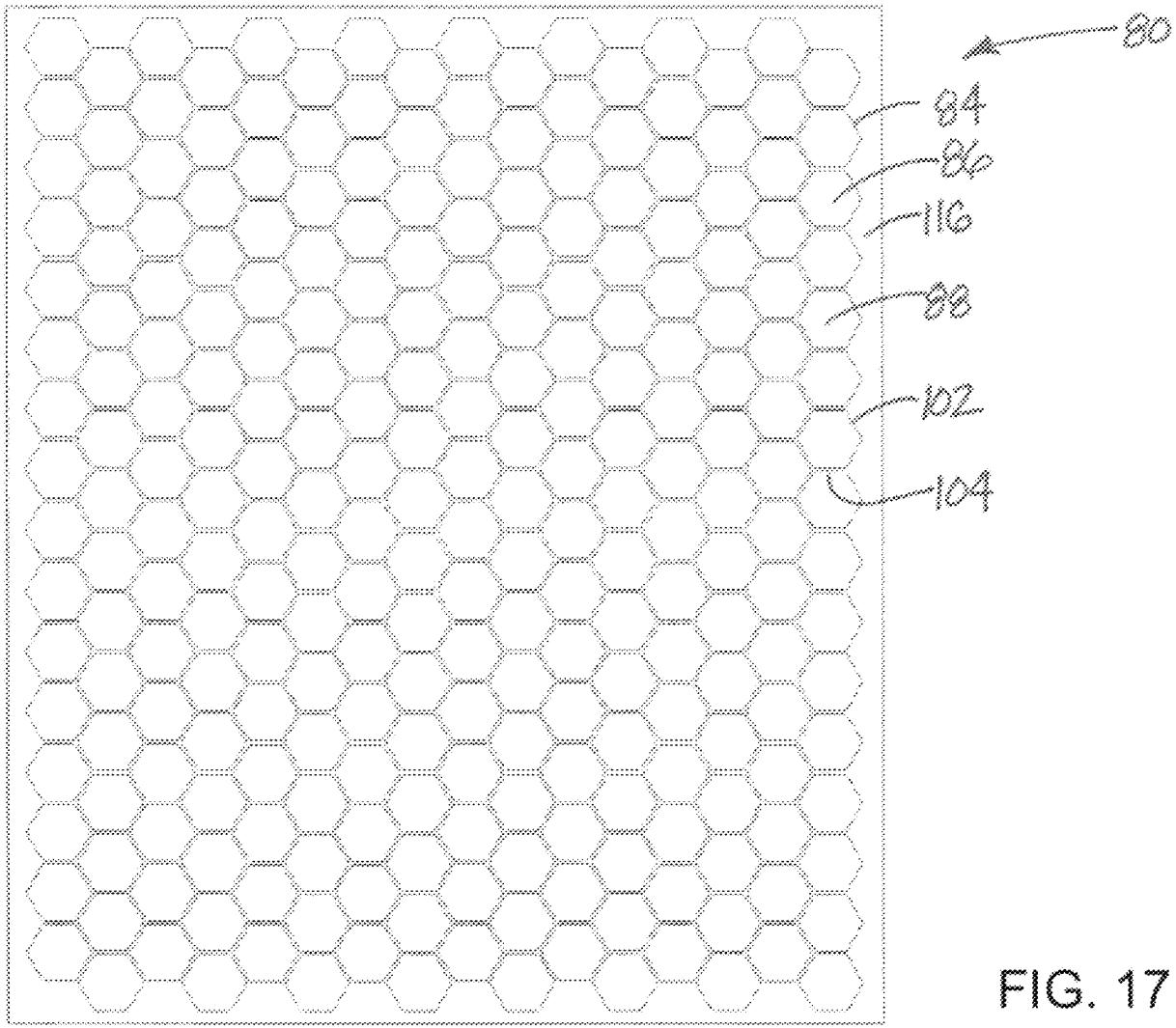
FIG. 17 is a schematic top view of the embodiment of a green simulation apparatus shown in FIG. 16.
Figure 18:
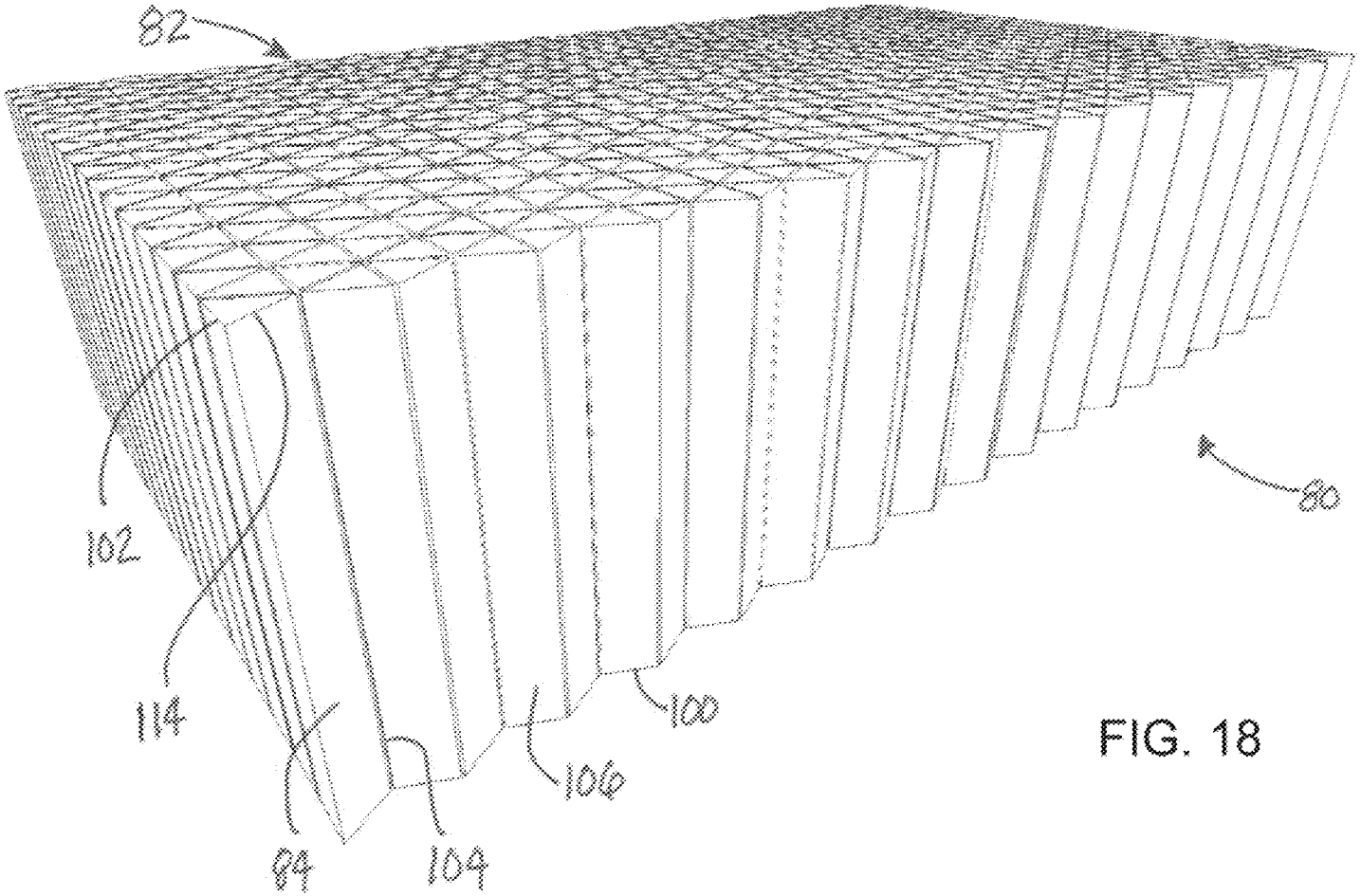
FIG. 18 is a schematic perspective view of an embodiment of a green simulation apparatus according to the present disclosure, showing surface elements with top surfaces having a triangular perimeter shape in a neutral position.
Figure 19:
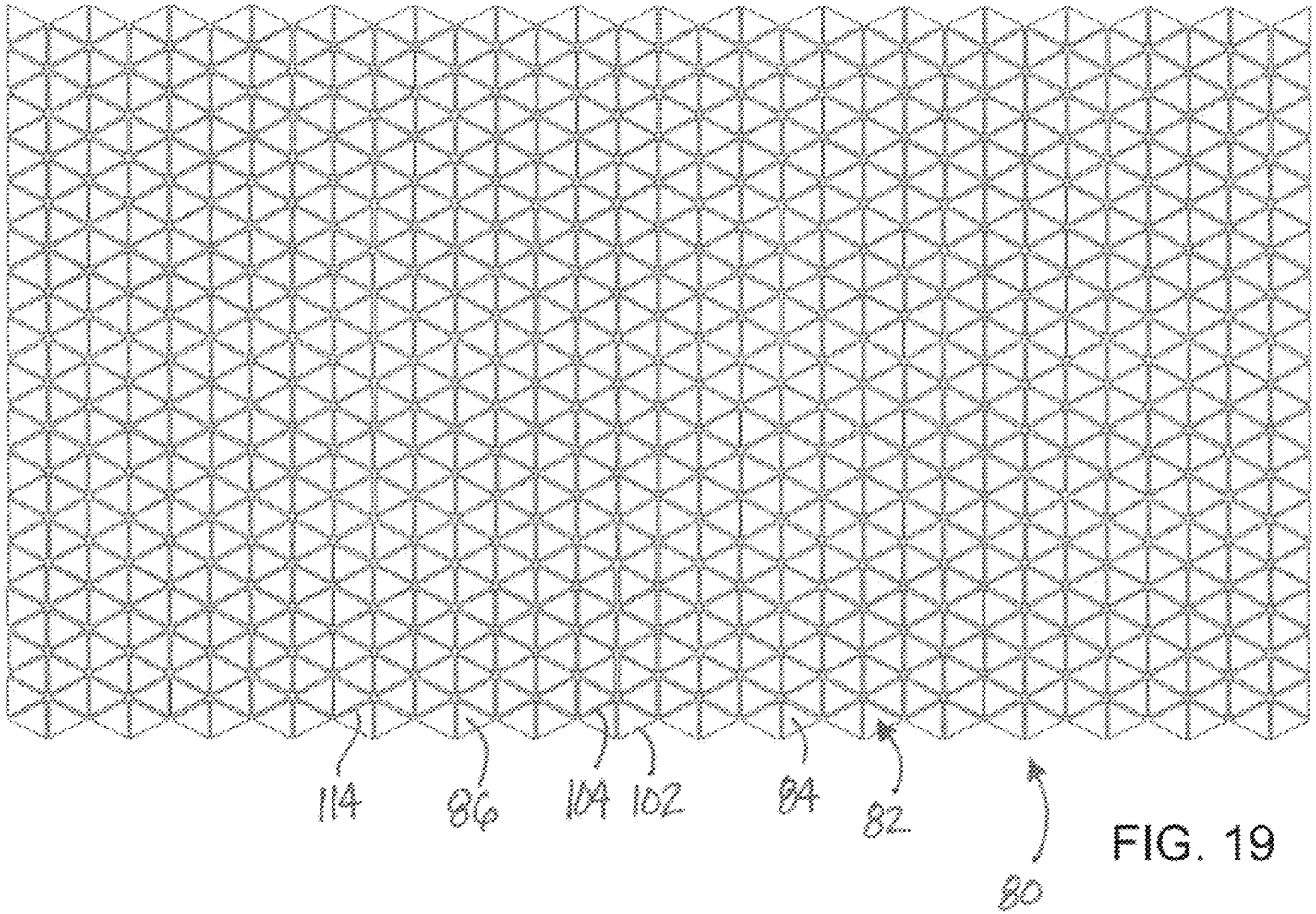
FIG. 19 is a schematic top view of the embodiment of a green simulation apparatus shown in FIG. 18.
Figure 21:
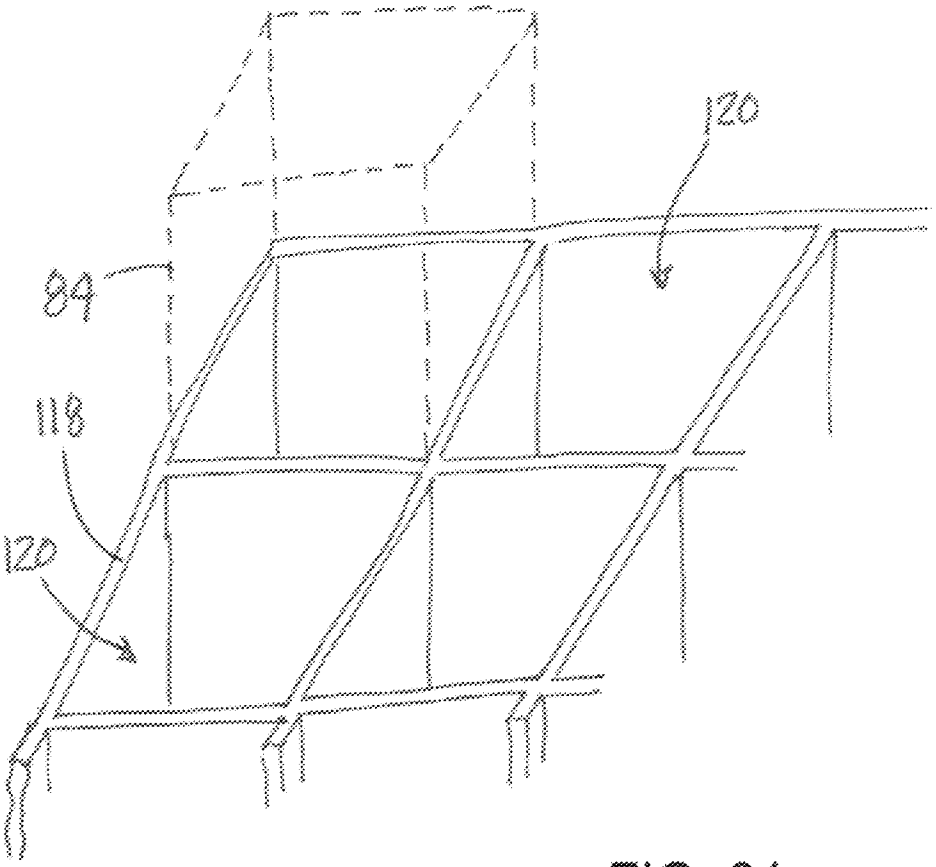
FIG. 21 is a schematic perspective view of a frame defining channels for the surface elements.

In some still further embodiments, the plurality of movable positioning elements may comprise a plurality of chambers 72 for receiving a fluid such as a liquid or a gas that is moved into and out of the chamber to expand or contract the volume of the chamber (see FIG. 9). The chamber may be defined by a flexible wall 74, such as a bag or balloon or sack that contains without leakage the fluid utilized which moves into and out of the chamber. The movement of the fluid into and out of the chambers may be individually controlled such that the chambers may be filled to different degrees to provide different levels of expansion and vertical lift of the covering positioned above the chamber.

In some optional embodiments, the covering 40 may be omitted and the upper end 44 of the positioning elements may collectively form the upper surface 22 of the apparatus, as if the upper end of each of the elements was a "pixel" of the upper surface. Illustratively, FIGS. 13 through 21 show a simulation apparatus 80 with a configurable upper surface 82 with a changeable contour, and the upper surface may form a play surface across which a golf ball or other object may roll. The upper surface 82 may have a periphery with the upper surface being substantially continuous between the periphery. The apparatus 80 may comprise a plurality of movable surface elements 84 that are positioned in a close array. Each element 84 may form a portion of the upper surface 82 of the simulation apparatus such that the upper surface is collectively formed by the elements 84. Each of the surface elements 84 may have a top surface 86 that forms a respective portion of the upper surface 82. Each of the surface elements 84 may be elongated with a longitudinal axis 87. The plurality of surface elements may be elongated with the top surface being located at an upper end 88 of the element, and a lower end 100 may be located opposite of the upper end. It will be appreciated that the longitudinal axis of the elements 84 may be substantially vertically oriented although this is not critical and may be horizontally oriented or oriented in other directions, and therefore the upper ends are not necessarily located higher than the lower ends.

The movable surface elements 84 may be movable to adjust the position of the top surface 86 of the respective element 84 with respect to other elements 84. Illustratively, the surface elements may be movable in a substantially vertically direction. The surface elements 84 may have a neutral position, and the top surfaces of surface elements in the neutral position may define a reference plane 90 (see FIG. 13). In addition to the neutral position, each surface element may also have a plurality of raised positions in which the top surface is located spaced or displaced from the neutral position, and may be vertically higher than, the reference plane 90 (see FIG. 14).

The top surface 86 of the surface element has a perimeter 102. In some embodiments, the perimeters of adjacent surface elements may have a gap 104 located therebetween, although in some embodiments there may not be any significant gap. The perimeters of the surface elements may be configured such that a width of the gap 104 between the perimeters 102 of the adjacent surface elements is substantially uniform, and may be configured such that the width of the gap is substantially uniform along substantially the entire perimeter 102 of the surface element. The gap between the surface elements may be minimal such that side surfaces 106 of the surface elements abut against the side surfaces of adjacent surface elements, and the side surfaces of one element 84 may be in sliding contact with the side surfaces of one or more adjacent surface elements. In such embodiments, the surface elements positioned about a surface element may function to guide movement of the surface element through the sliding contact.

Figure 20:
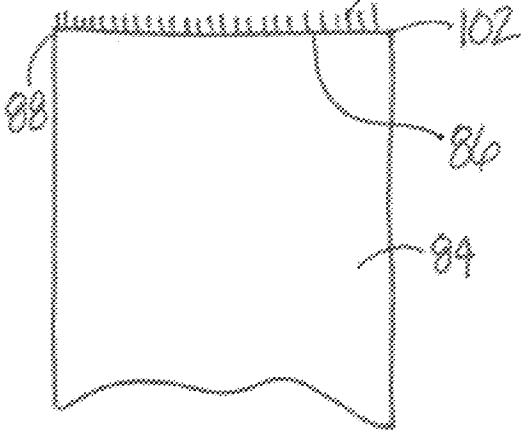
FIG. 20 is a schematic side view of a surface element showing turf elements.
Figure 22:
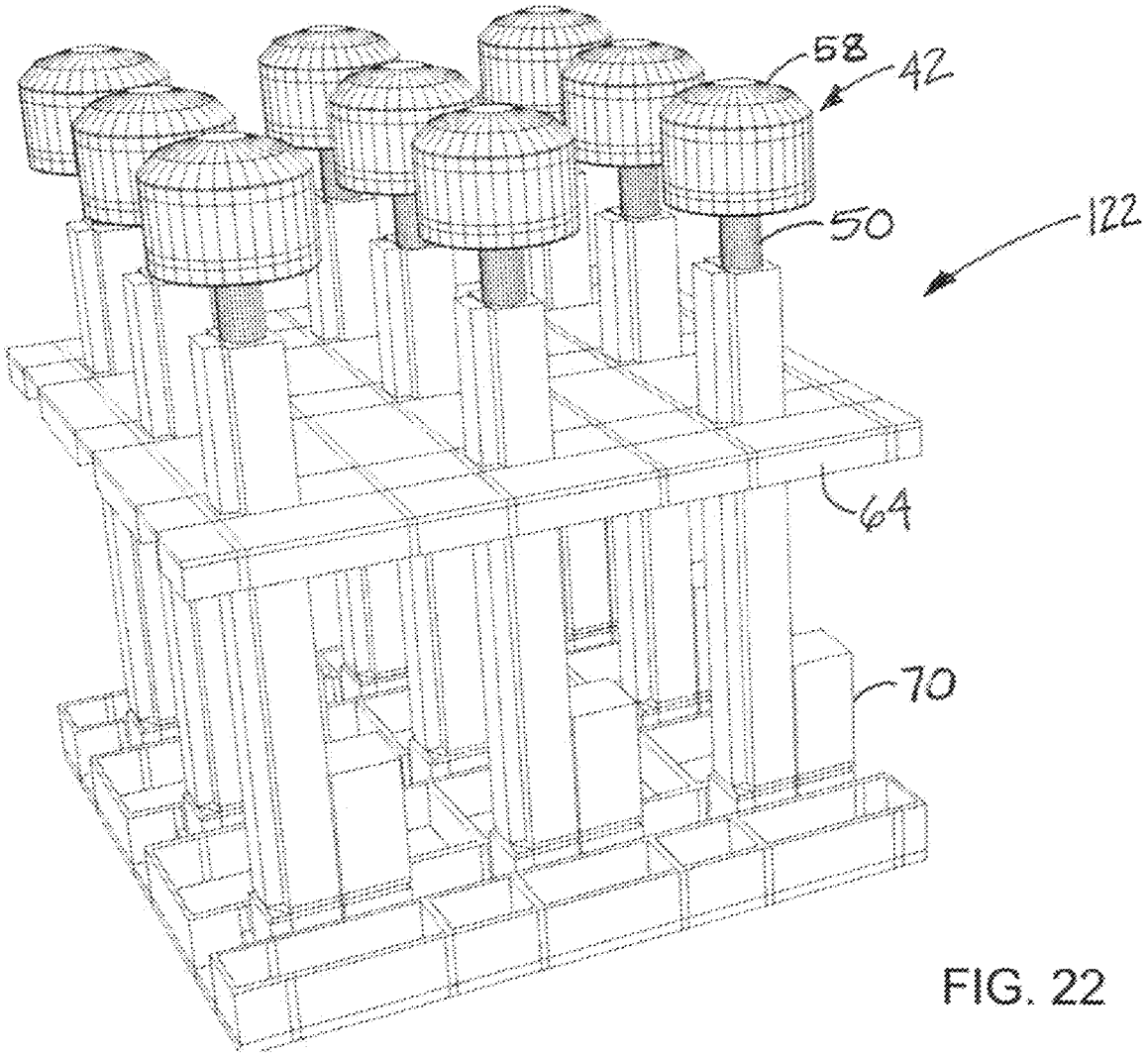
FIG. 22 is a schematic perspective view of a module of an embodiment of the covering support assembly, with the covering removed to show detail of the positioning elements.

In some embodiments, the top surface 86 may be textured, and may have turf elements 108 positioned thereon to simulate turf or grass on the top surface (see FIG. 20). The turf elements 108 may comprise filaments that extend from the top surface 86.

Optionally, the top surface 86 of each surface element 84 may have a cover patch mounted the surface 86. In some embodiments, a perimeter of the cover patch may be larger in size and area than the top surface of the surface element such that the perimeter extends beyond the borders of the perimeter 102 of the top surface, and the cover patch of one surface element may overlap a portion of the cover patch of an adjacent surface element.

The perimeter 102 of the surface element has a perimeter shape, and in the most preferred embodiments the perimeter shape may be uniform for each of the surface elements. In some embodiments, the perimeter shape may be formed of a plurality of straight lines to form edges 114 of the top surface for positioning adjacent to edges 114 of the top surfaces of the adjacent surface elements. The perimeter shape may be a regular shape, and in some embodiments, the perimeter shape is substantially rectangular (see FIGS. 13 through 15), substantially hexagonal (see FIGS. 16 through 17), substantially triangular (see FIGS. 18 through 19) as a few illustrative examples. The surface elements may have a substantially uniform lateral cross sectional shape from the upper end 88 to the lower end 100.

The top surface 86 may have a substantially planar contour which may lie in a plane oriented substantially perpendicular to the longitudinal axis 87 of the surface element, although in some embodiments the contour of the top surface may be somewhat or slightly domed.

Optionally, a band 116 may extend about the plurality of surface elements 84 to hold the elements 84 together, and portions of the band may extend along the lateral sides and opposite ends of the simulation apparatus. The band 116 may extend in a substantially horizontal plane where the longitudinal axes 87 are vertically oriented. The portions of the band may have inner surfaces positioned and contoured to follow contours of the side surfaces 106 of the surface elements at the lateral sides and ends of the apparatus. As a further option, a frame 118 may form a plurality of channels 120 (see FIG. 21), with each of the channels receiving one of the movable surface elements 84. The channels 120 may have an axis extending substantially parallel to a direction of movement of the surface elements, and the channels may have a cross sectional shape that corresponds to the shape of the perimeter of the surface element.

A movement actuator may be configured to move a surface element 84 independently of other positioning elements, and may act on the lower end of the surface element although this is not critical. The movement actuator may have various characteristics and configurations of the movement actuators described in this disclosure.

Figure 23:
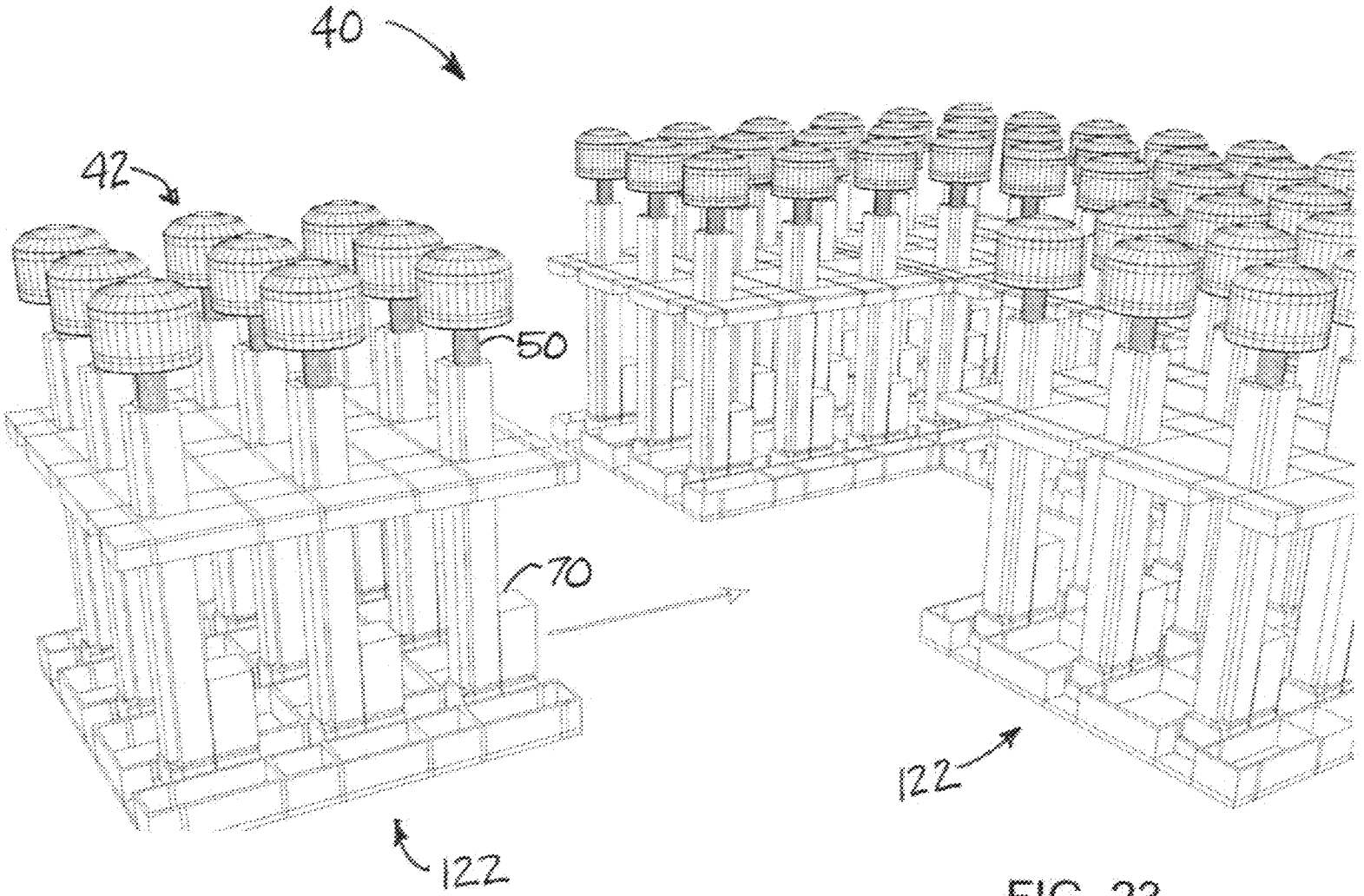
FIG. 23 is a schematic perspective view of a module removed from an array of modules of an illustrative embodiment of the covering support assembly.
Figure 25:
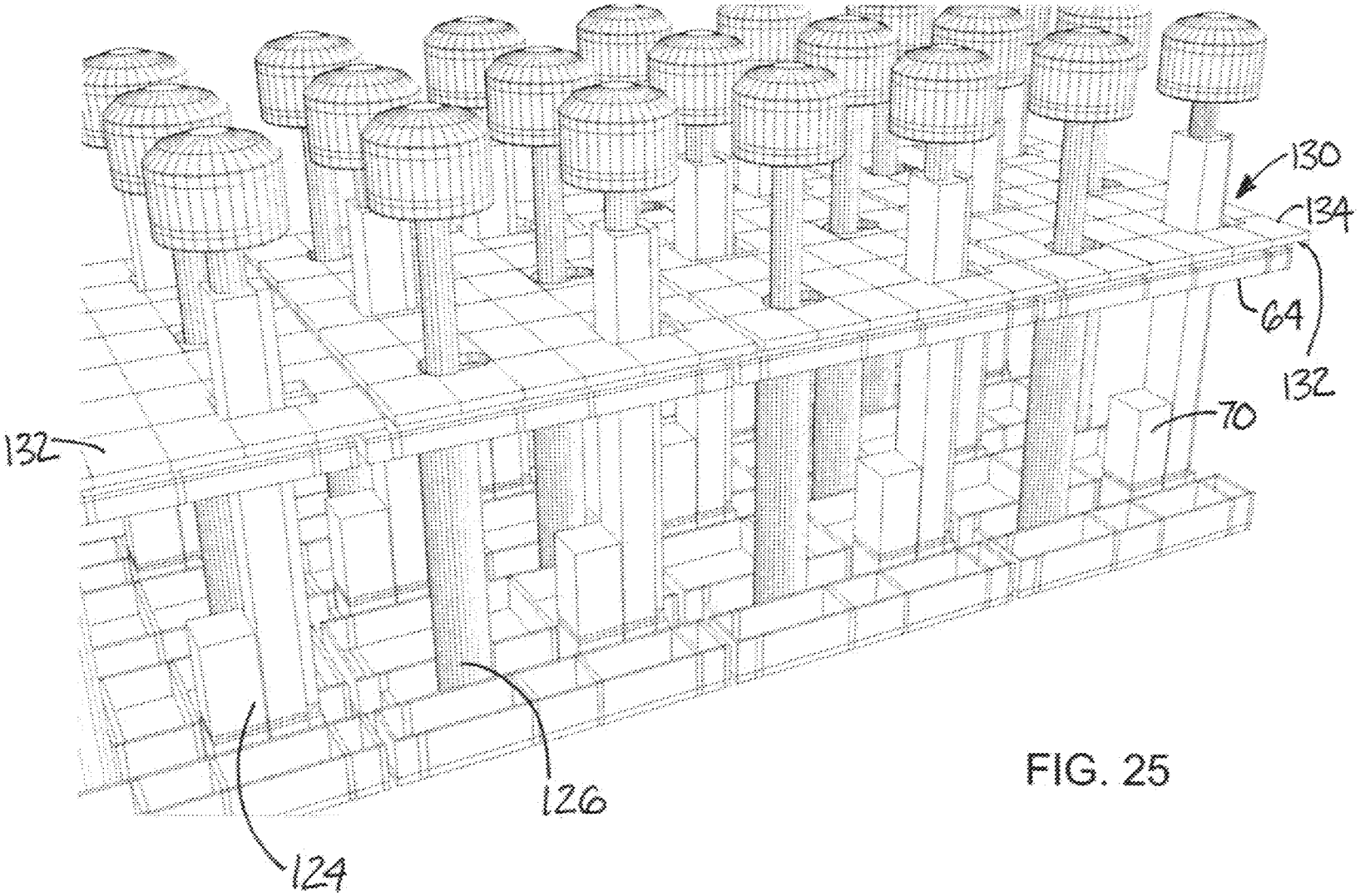
FIG. 25 is a schematic perspective view of an array of modules of active and passive positioning elements, according to an illustrative embodiment.
Figure 26A:
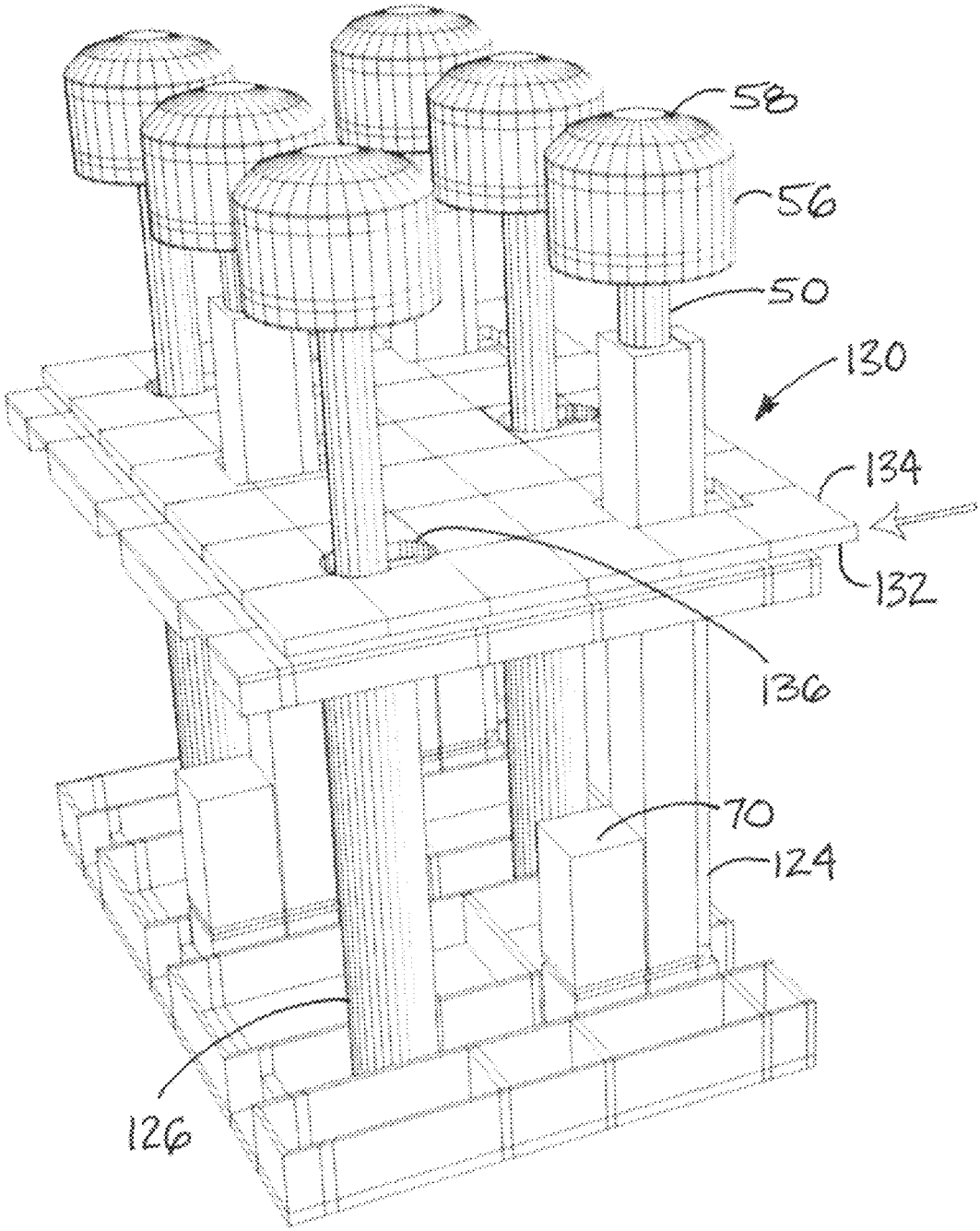
FIG. 26A is a schematic perspective view of a module of active and passive positioning elements, according to an illustrative embodiment.
Figure 26B:
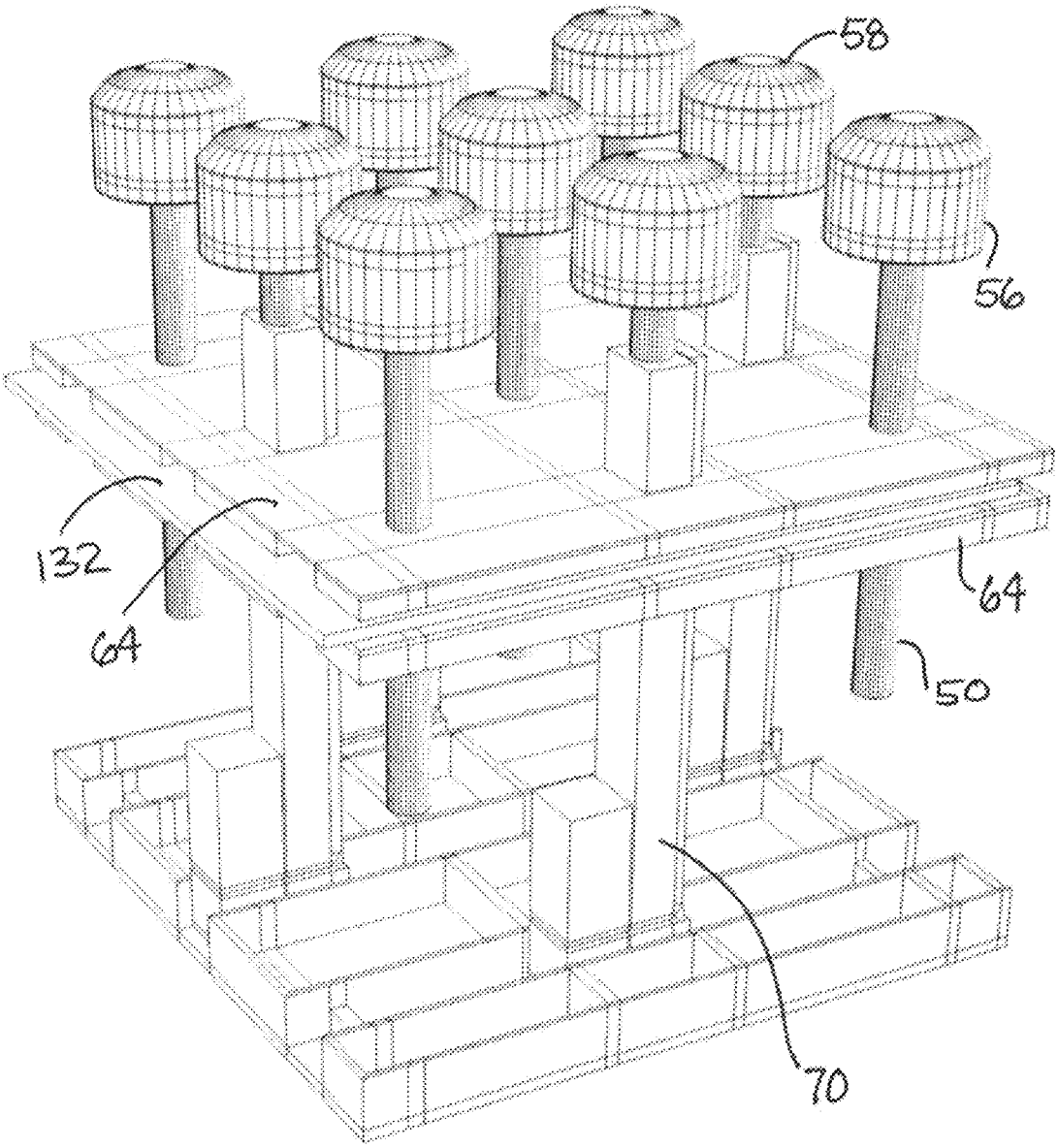
FIG. 26B is a schematic perspective view of a module of active and passive positioning elements, particularly showing an embodiment in which passive positioning elements lack movement actuators and guide tubes are removed from the passive positioning elements to show detail, according to an illustrative embodiment.
Figure 27:
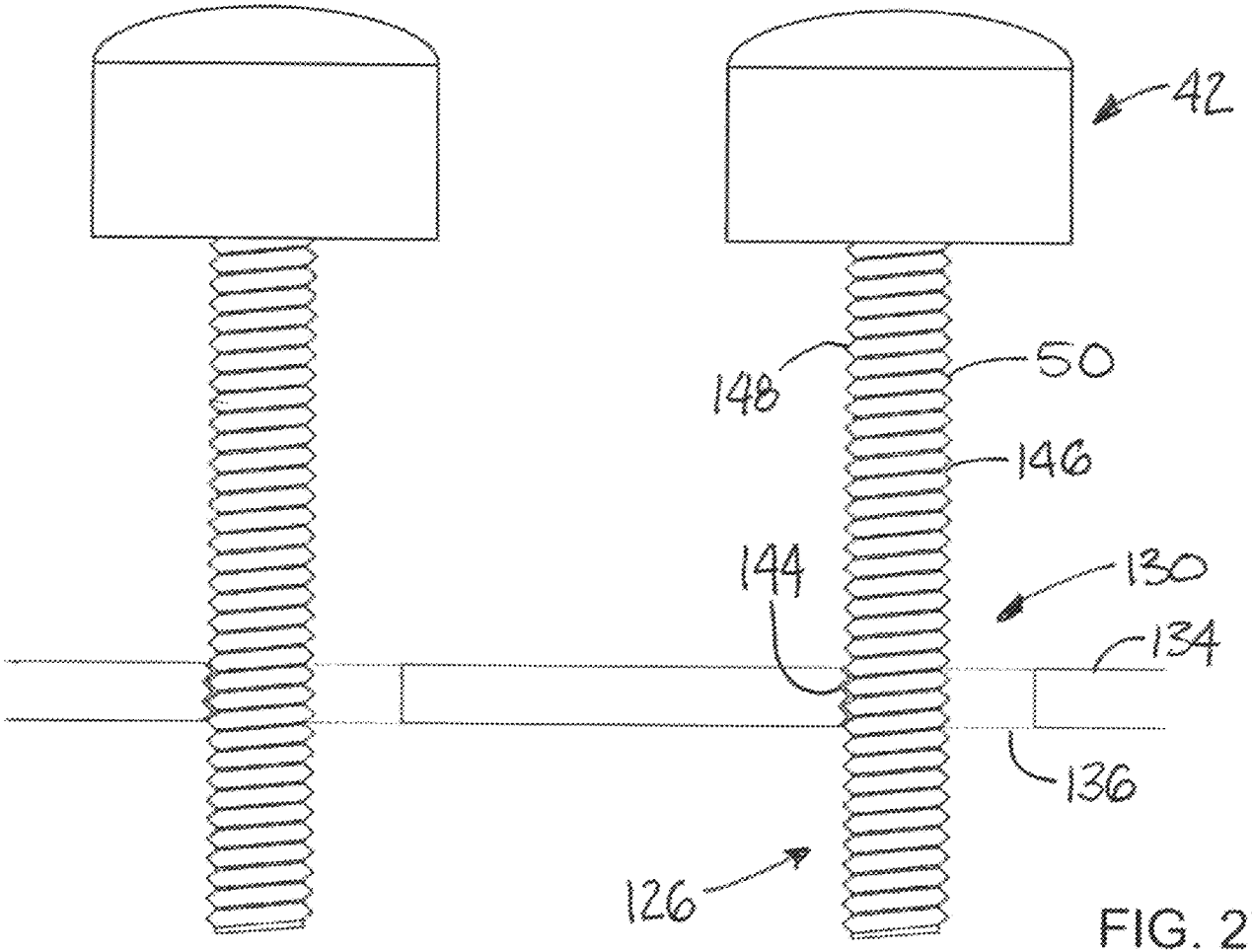
FIG. 27 is a schematic side view of positioning elements and an illustrative embodiment of a locking assembly shown in a locked position.
Figure 28:
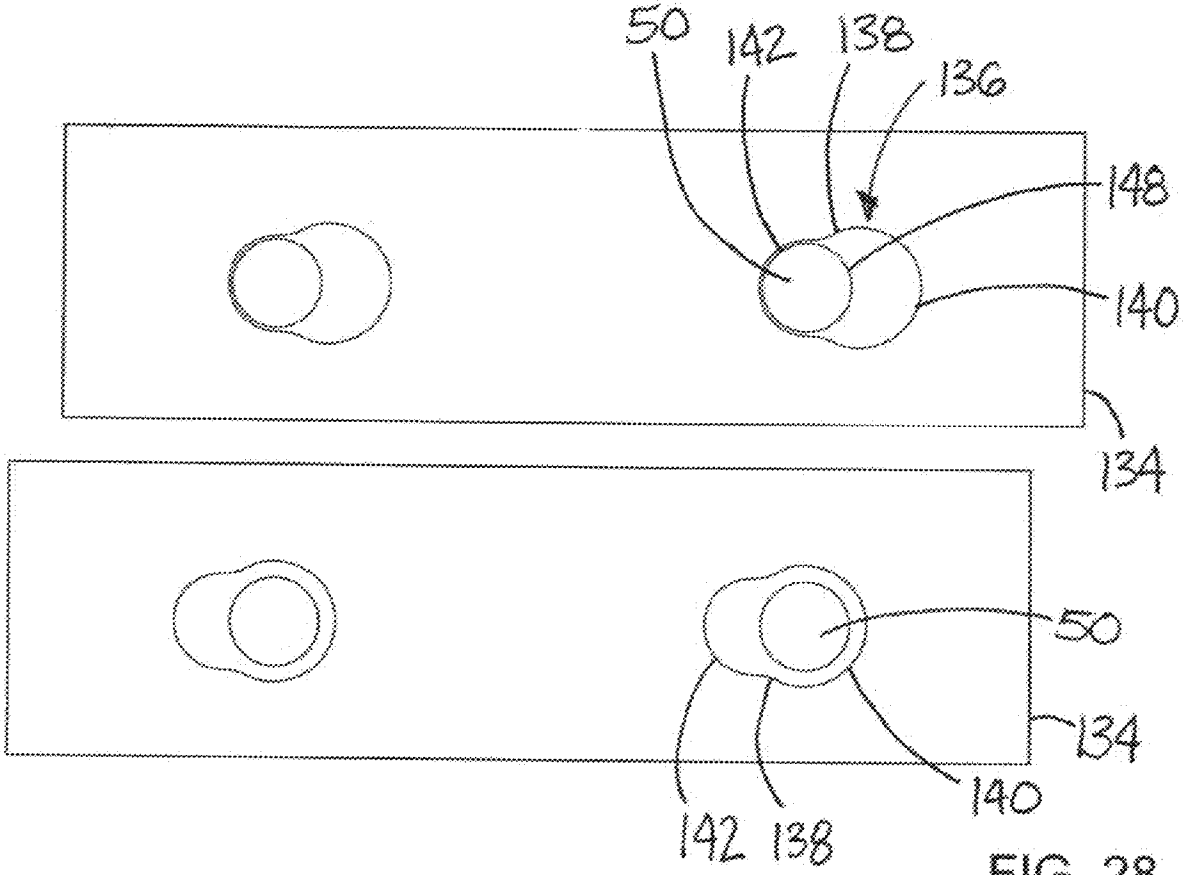
FIG. 28 is a schematic top view of positioning elements of FIG. 27 in a lock condition (above) with the lock plate in the lock position and the pins in the lock area of the aperture, and in a free condition (below) with the lock plate in the release position and the pins in the free area of the aperture, according to an illustrative embodiment.
Figure 29:
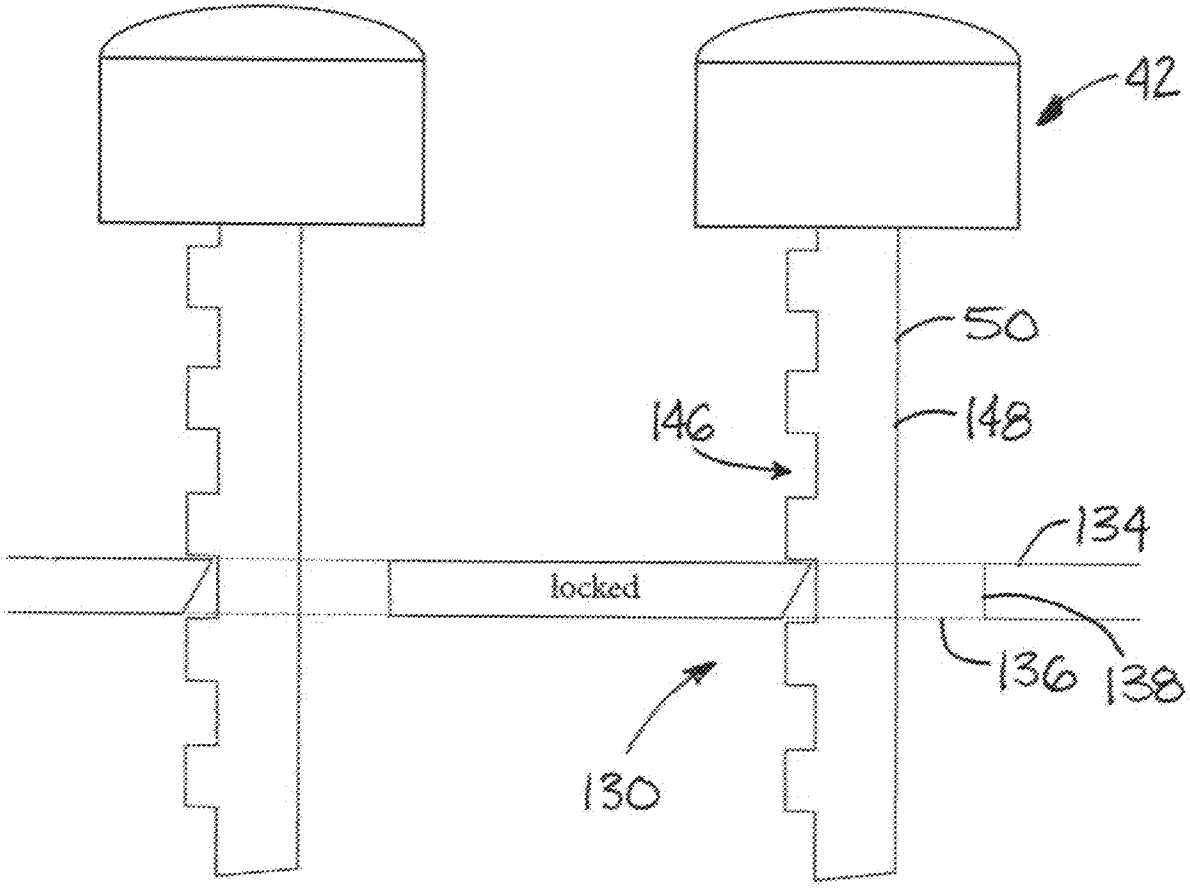
FIG. 29 is a schematic side view of positioning elements and another illustrative embodiment of a locking assembly of an embodiment shown in a locked position.
Figure 30:
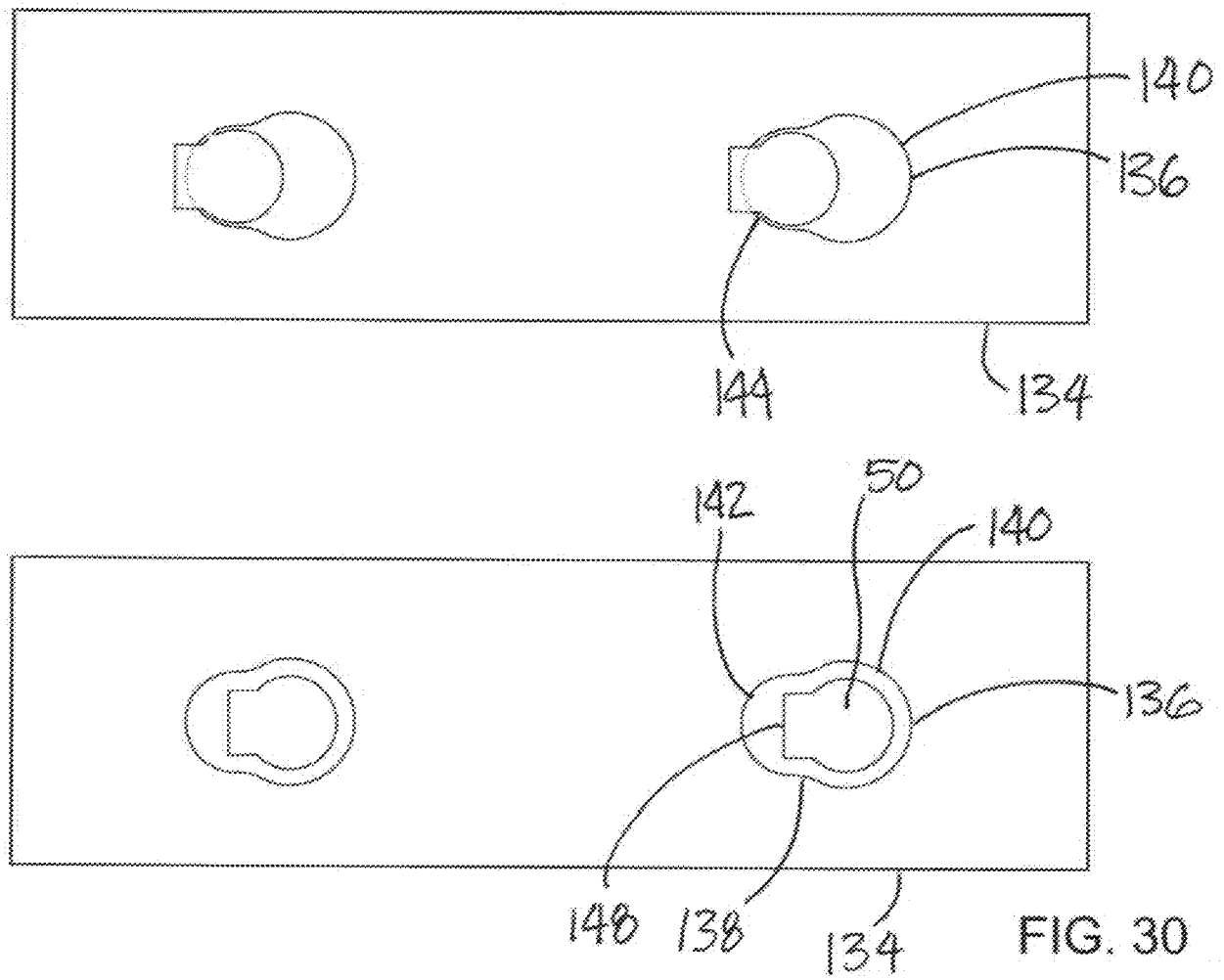
FIG. 30 is a schematic top view of positioning elements of FIG. 29 in a lock condition (above) with the lock plate in the lock position and the pins in the lock area of the aperture, and in a free condition (below) with the lock plate in the release position and the pins in the free area of the aperture, according to an illustrative embodiment.
Figure 31:
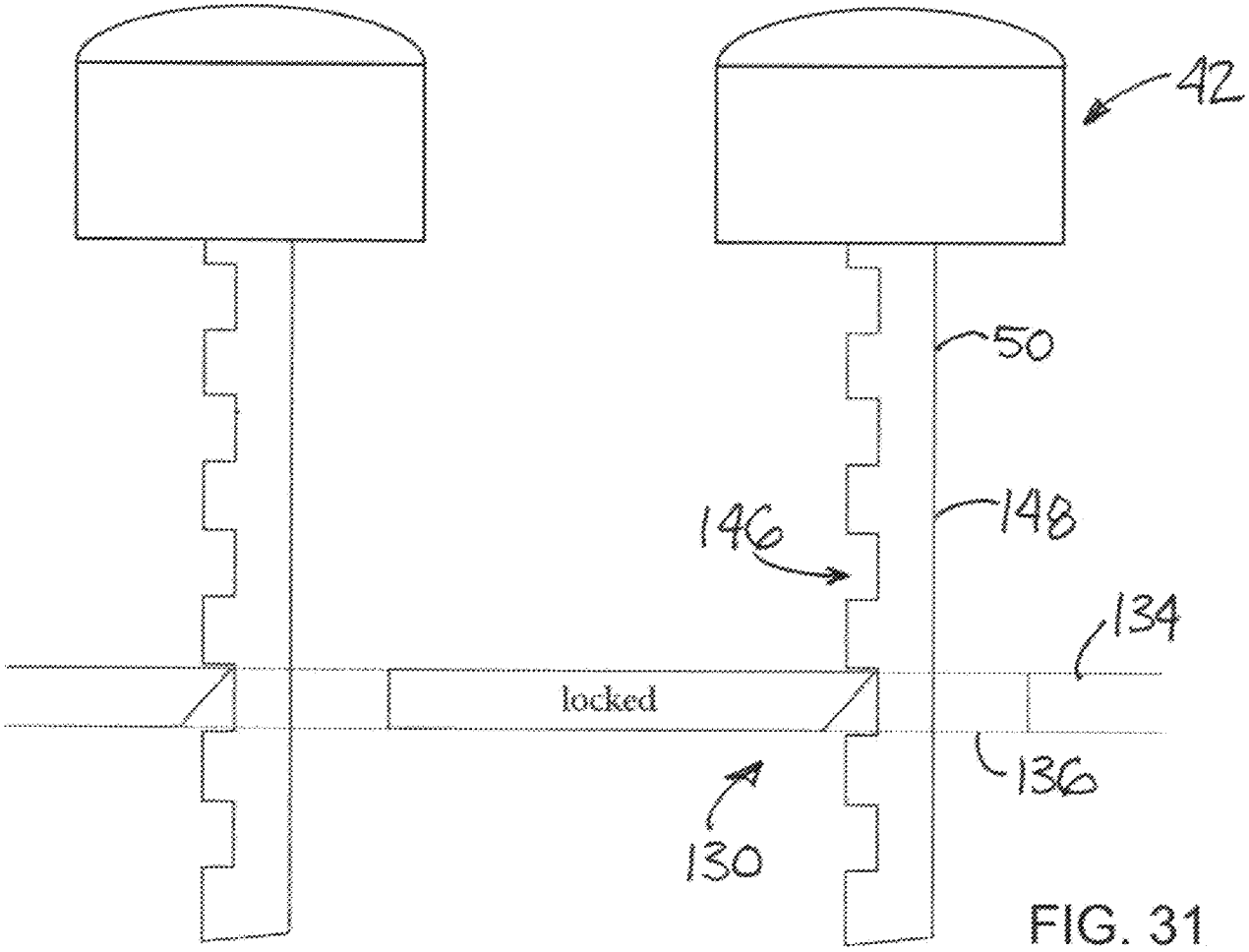
FIG. 31 is a schematic side view of positioning elements and still another illustrative embodiment of a locking assembly of an embodiment shown in a locked position.
Figure 32:
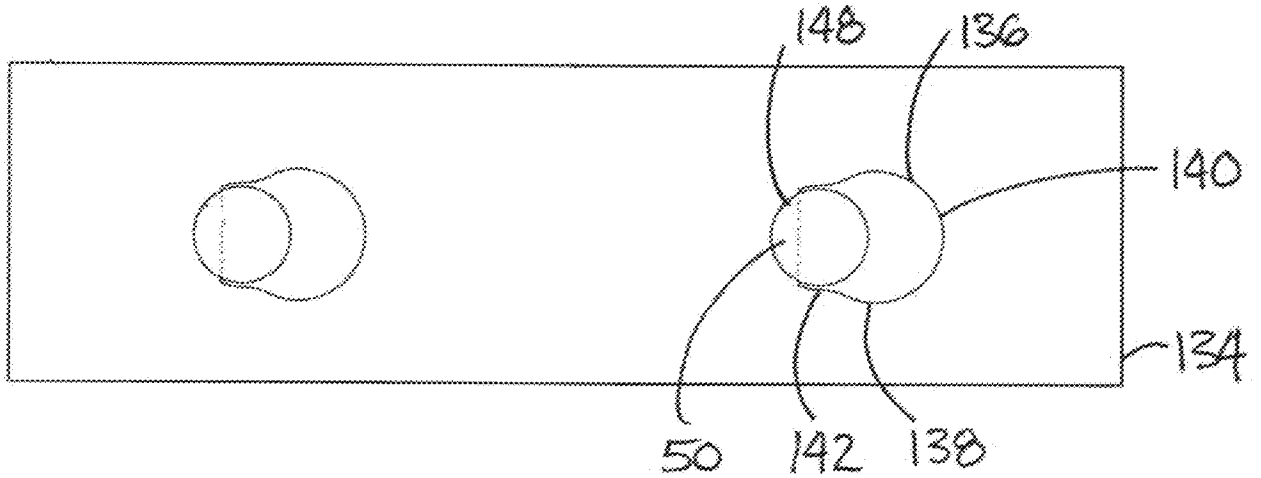
FIG. 32 is a schematic top view of positioning elements of FIG. 31 in a lock condition (above) with the lock plate in the lock position and the pins in the lock area of the aperture, and in a free condition (below) with the lock plate in the release position and the pins in the free area of the aperture, according to an illustrative embodiment.
Figure 32:
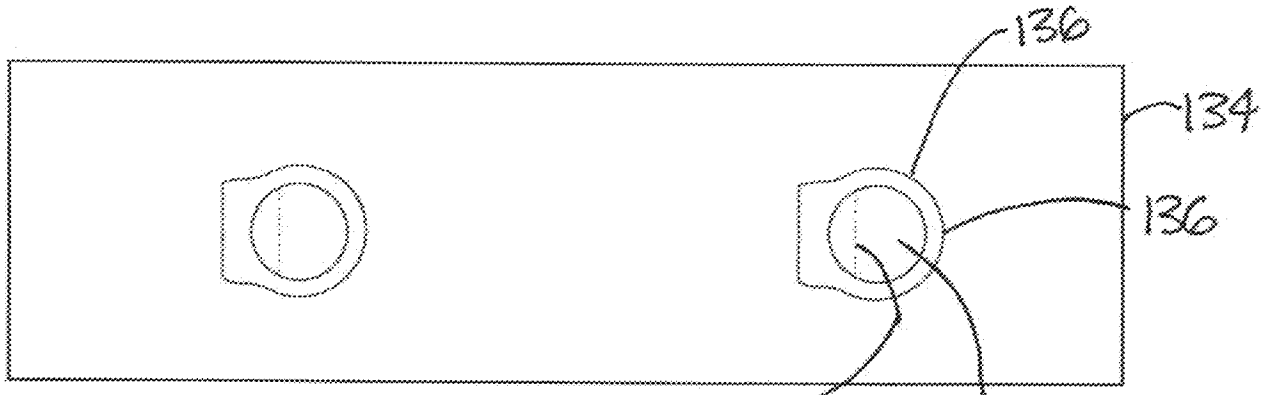
Figure 33:
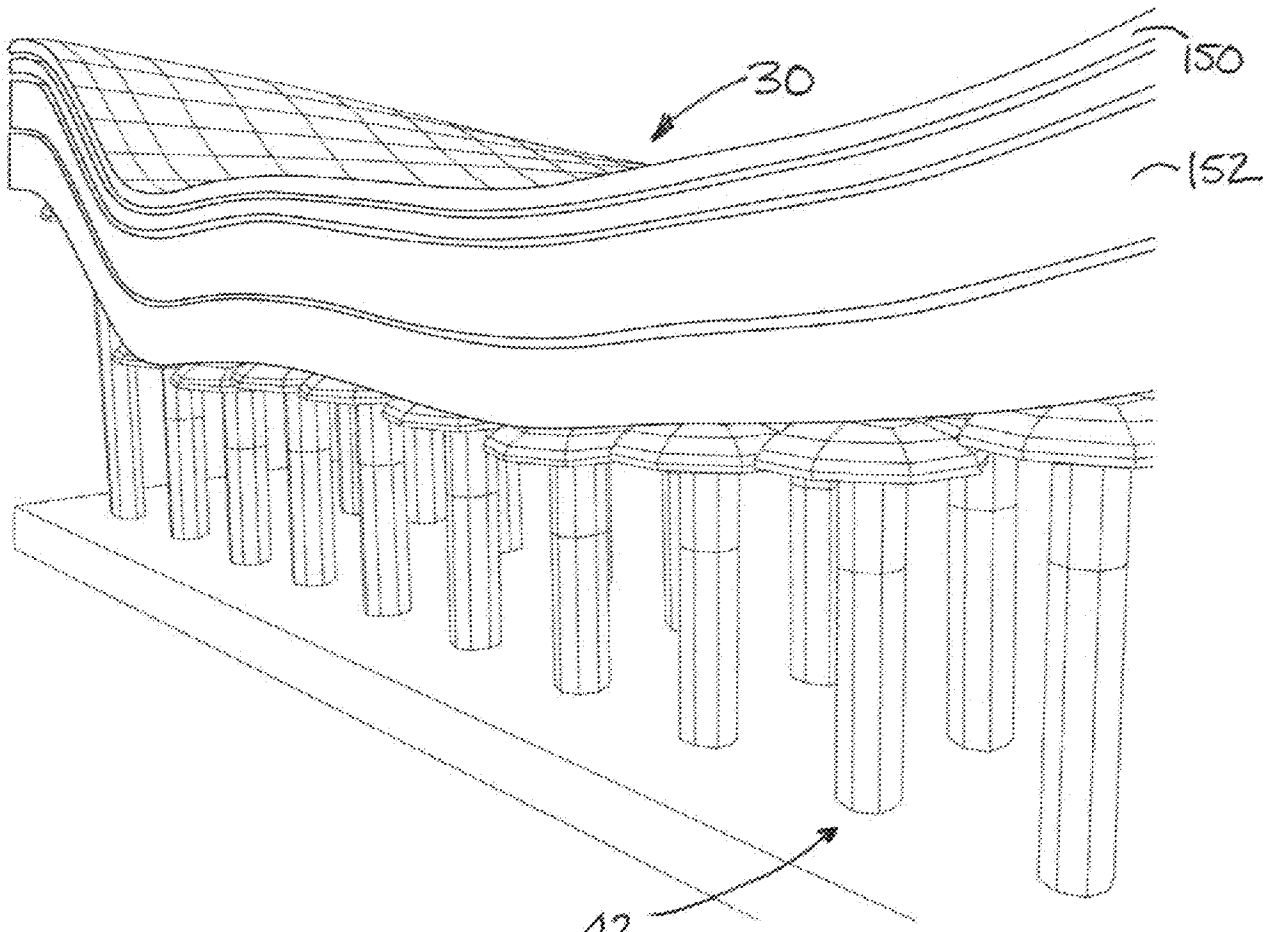
FIG. 33 is a schematic perspective view of an embodiment of the green simulation apparatus showing a covering including a plurality of layers.

The covering support assembly 40 may comprise a plurality of modules 122 (see FIGS. 22 and 26), with the modules being positioned adjacent to each other in an array of the modules (see FIGS. 23 and 25). Each of the modules 122 may include a plurality of the movable positioning elements 42 in an array, although a module having a single positioning element may be utilized for greater flexibility in shaping a perimeter of the apparatus 20. In modules 122 having a plurality of positioning elements, the number of elements 42 in the array may be substantially equal in both the X- and Y-directions. In other embodiments, the number of elements 42 in the array may be unequal in both the X- and Y-directions. The modules may be positioned adjacent to each other to create a larger size or area for the green simulation apparatus of varying size or shape of the perimeter of the apparatus. Each of the modules may have a substantially rectangular shape when viewed from above and along an axis generally parallel to the longitudinal axes of the pins, and in some embodiments the modules may be substantially square in shape with an equal number of positioning elements in an X direction and in a Y direction. In some embodiments, the covering may have a lateral extent that generally corresponds to the lateral extent of the module.

Figure 24:
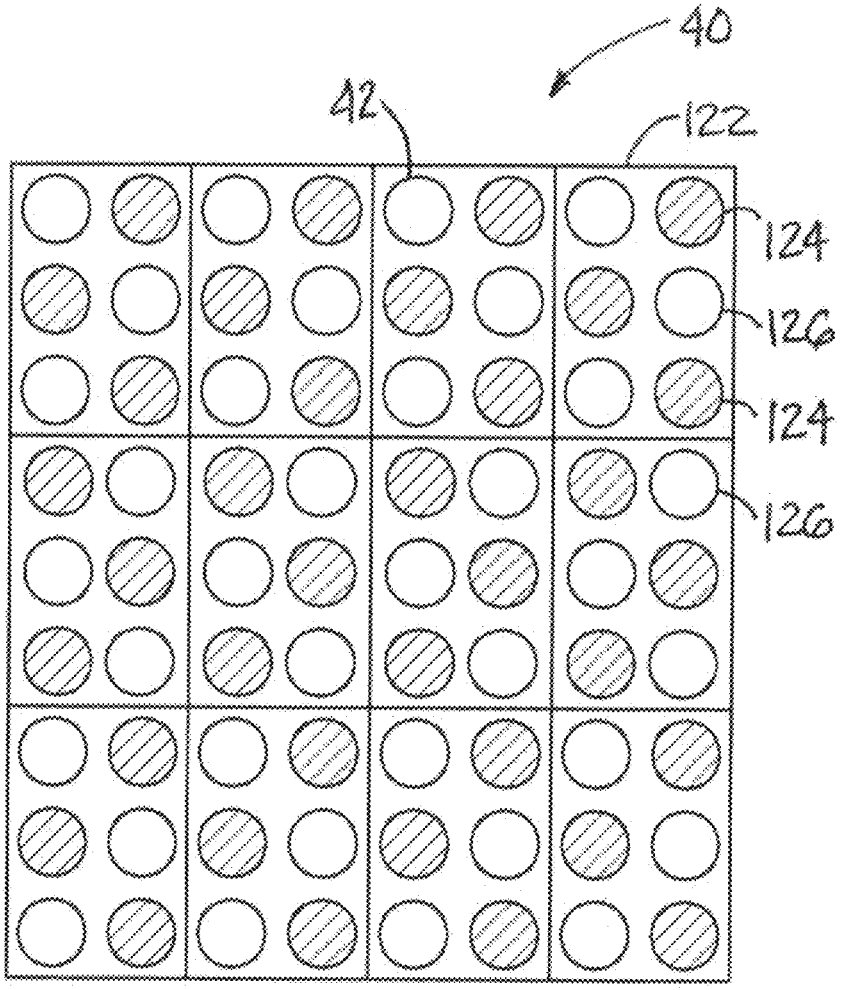
FIG. 24 is a schematic top diagrammatic view of an array of modules with positioning elements showing an illustrative pattern of active and passive positioning elements, according to an illustrative embodiment.

In some embodiments, the covering support assembly may include movable positioning elements 42 that are active and movable positioning elements that are passive (see FIGS. 24 through 32). Illustratively, the active positioning elements 124 may be associated with movement actuators, and the passive positioning elements 126 may not be associated with movement actuators, or may have movement actuators that are deactivated. The active positioning elements 124 may actively move against the covering to, for example, lift the covering to a desired position at the location of the positioning element. The passive positioning elements 126 may passively move in reaction to, or because of, the movement of the covering 30 by the active positioning element or elements. The passive movement of the passive positioning elements may be caused or influenced in various manners. Illustratively, in embodiments in which the upper end 44 of the passive positioning elements are attached to the bottom face 34 of the covering, the movement of the covering by the active positioning elements 124 may tend to move the passive positioning elements 126 connected to the covering. For example, movement of the covering by the active positioning elements in an upward direction may cause the covering to pull the attached passive elements upward. The passive movement of the passive positioning elements may be caused in other suitable ways, even without a direct connection of the top end to the covering, such as by applying a small degree of upward biasing force on the passive movement elements so that the elements 126 are caused to follow the upward movement of the covering when raised by active positioning elements as well as being pushed downwardly when the active positioning elements move downwardly. The active and passive positioning elements may be positioned in any suitable arrangement. Illustratively, FIG. 24 shows one suitable arrangement of active 124 and passive 126 positioning elements in modules in which the array of elements substantially alternates between the active and passive elements. The illustrative modules 122 include six positioning elements, and each row may include substantially similarly configured modules in similar orientations, with the modules of an adjacent row being rotated approximately 180 degrees to create an pattern of alternating orientations in each column, providing the alternating pattern of active and passive elements without requiring different module configurations.

The apparatus 20 may be configured to selectively lock and unlock the position of the positioning elements, and in particular the passive positioning elements, to maintain a raised position of the elements between movement of the elements to a desired position. Illustratively, the positioning elements, or at least the active positioning elements, may be moved to positions that create the desired contour in the top face 32 of the covering. By virtue of the movement of the covering 30 by the active positioning elements 124, the passive positioning elements 126 may also be moved to positions that abut or contact the bottom face 34 of the covering, such as by attachment of the passive elements to the covering or by an upward bias on the passive elements. The positions of the positioning elements may be locked or secured in the positions that result, thus providing the covering 30 with support at the locations of each of the positioning elements, whether active or passive. When it is desired to change the contour of the covering, requiring a repositioning of the positioning elements, the elements may be released from the locked or secured condition.

The covering support assembly 40 may include a locking assembly 130 for selectively locking the position of at least one of the positioning elements in a selected raised position. In some embodiments, the locking assembly may comprise at least one lock element 132 that is configured to selectively lock at least one of the positioning elements in at least one raised position. In some embodiments, the locking element may engage all of the active and passive positioning elements, and in other embodiments the locking elements may engage the passive positioning elements.

The lock element may comprise a lock plate 134 having at least one aperture 136 with one of the positioning elements 42 being positioned in the aperture, and in some embodiments the pin 50 of the positioning element may extend through the aperture. An aperture may be provided for each of the positioning elements to be locked into position, although this is not critical. The lock plate 134 may have a perimeter edge 138 which forms each of the apertures, and the perimeter edge may define a free area 140 and a lock area 142 within each of the apertures. At least a portion of the lock area may be located in a notch 144 formed in the perimeter edge 138. The lock plate 134 may be laterally movable relative to the positioning elements in order to change a position of the pin 50 of the positioning element in the aperture. The lock plate may thus be movable in a plane that is oriented substantially perpendicular to the longitudinal axes of the positioning elements. The lock plate may be movable relative to the positioning element to thereby move the pin between the free area 140 and the lock area 142 of the aperture, and correspondingly the lock plate may be movable between a lock position (see FIGS. 27, 29 and 31, and the upper positions of FIGS. 28, 30, and 32) and a release position (see FIGS. 25 and 26, and the lower positions of FIGS. 28, 30, and 32). The pin 50 may be positioned in the free area in the aperture 136 when the lock plate is in the release position for a free condition (see FIGS. 25 and 26, and the lower positions of FIGS. 28, 30, and 32) in which the pin is substantially freely movable with respect to the lock plate. The free condition of the pin may be characterized by the pin being substantially free of contact with the perimeter edge 138. The pin is positioned in the lock area of the aperture when the lock plate is in the lock position to create a locked condition (see FIGS. 27, 29 and 31, and the upper positions of FIGS. 28, 30, and 32). The locked condition of the pin is characterized by the perimeter edge of the aperture engaging one of the recesses 146 of the pin in a manner that resists or blocks movement of the pin in a direction substantially parallel to its longitudinal axis.

The pin 50 of the positioning element engaged by the lock element may have a length as well as an exterior surface 148 that extends along at least a portion of the length of the pin. The pin may also have at least one of the recesses formed therein, and may preferably include a plurality of recesses formed in the exterior surface that are arrayed along a portion of the length of the pin and may be substantially uniformly spaced from each other. The recesses may be formed by indentations (see FIGS. 31 and 32) that extend into the exterior surface 148 of the pin, or may be formed between a series of protrusions (see FIGS. 29 and 30) formed on the pin such that the recesses are effectively located between the protrusions.

Figure 2:
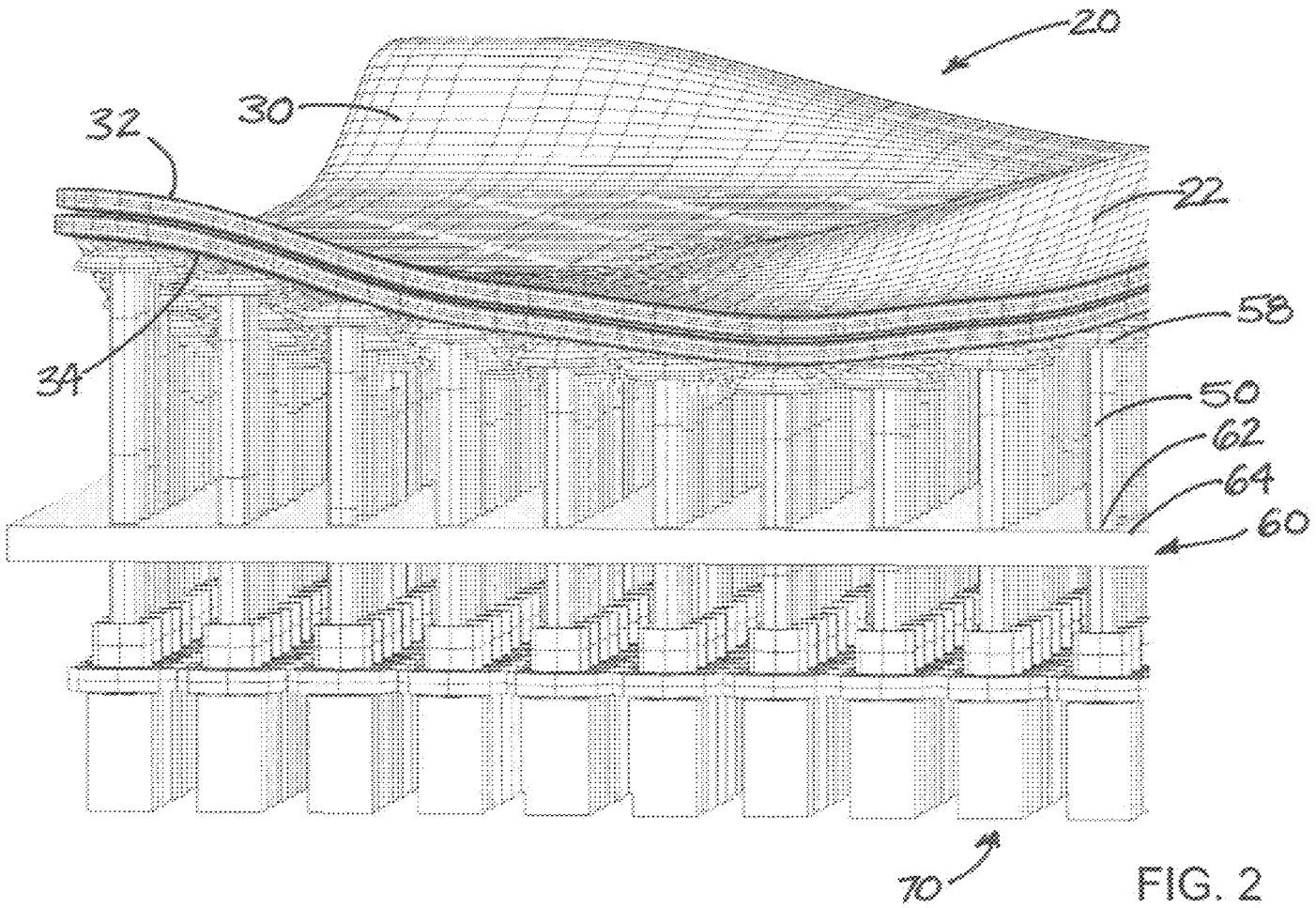
FIG. 2 is a schematic perspective view of the simulation apparatus with the covering in a contoured condition and the support assembly in a raised position.
Figure 3:
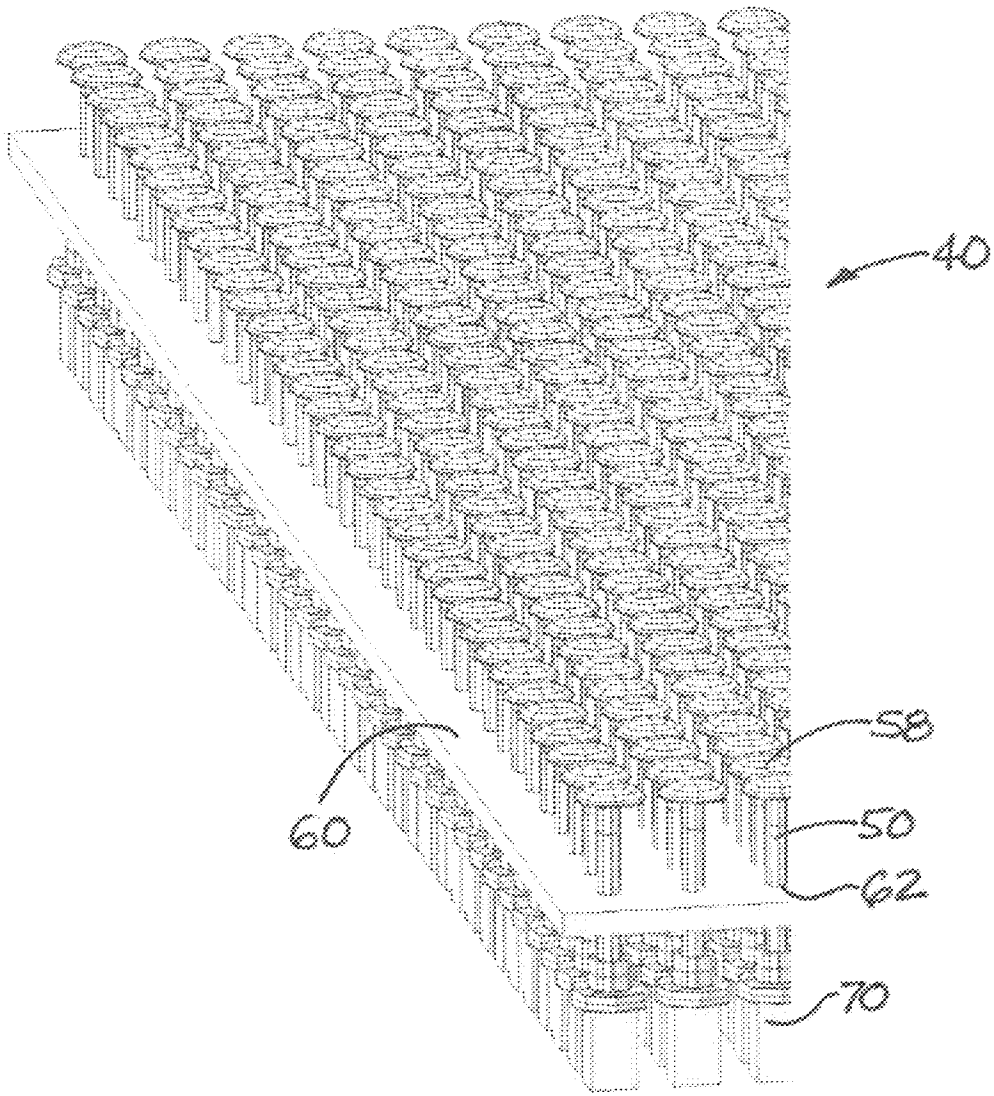
FIG. 3 is a schematic perspective view of the support assembly with the covering removed to show detail of the positioning elements, the guide and the movement actuators in the neutral position.
Figure 4:
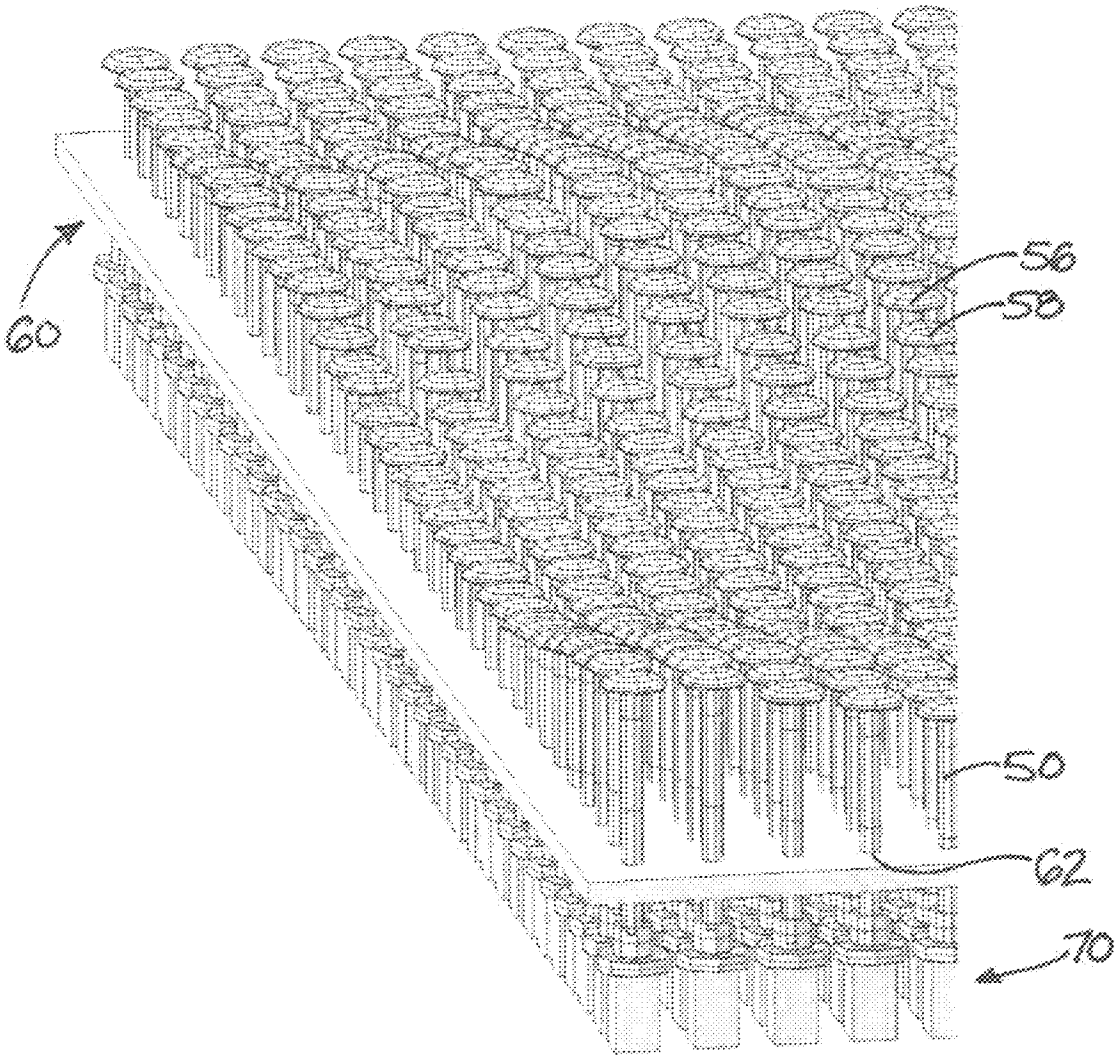
FIG. 4 is a schematic perspective view of the support assembly with the covering removed to show detail of the positioning elements, the guide and the movement actuators in the raised position.
Figure 5:
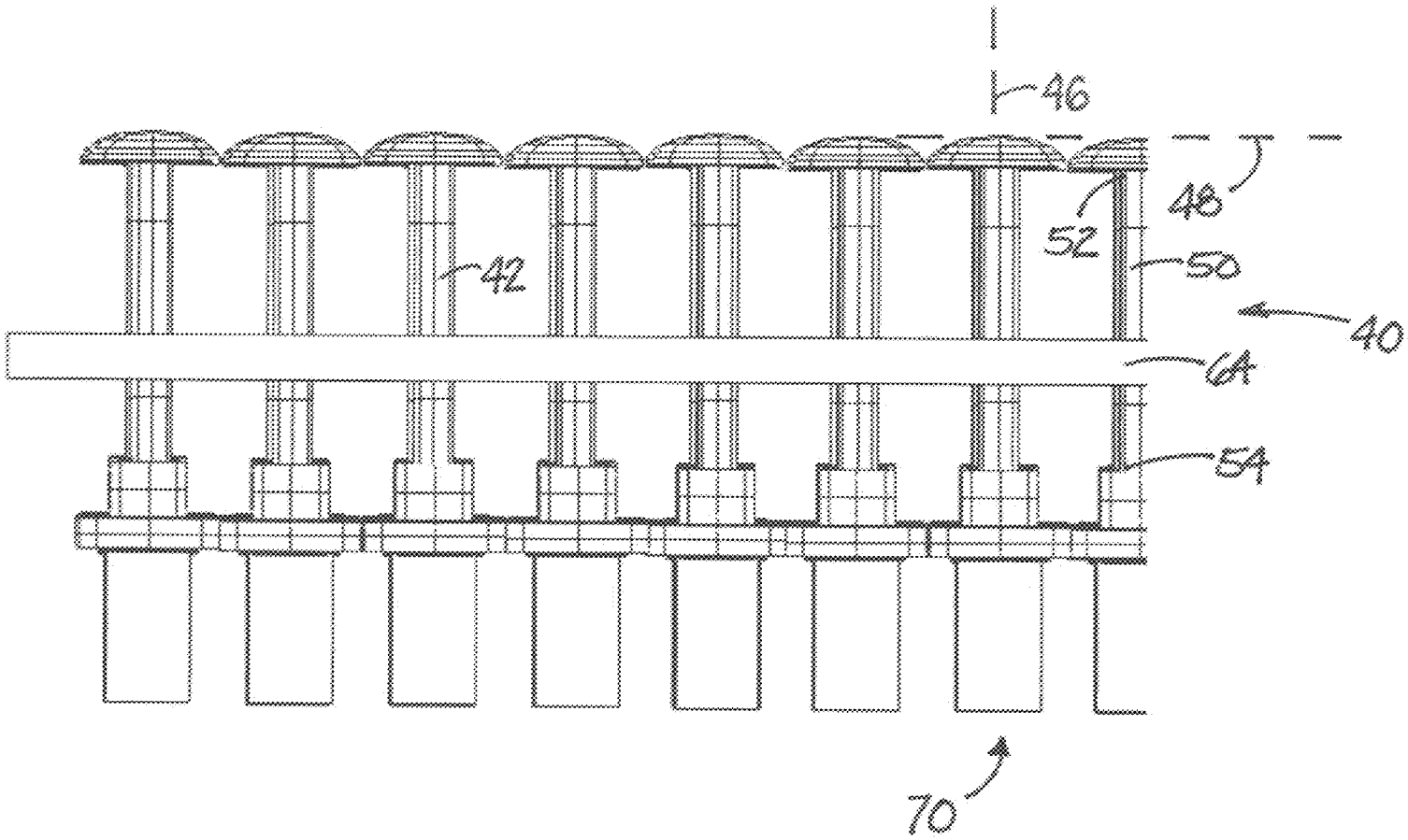
FIG. 5 is a schematic side view of the support assembly with the covering removed to show detail of the support assembly in the neutral position.
Figure 6:
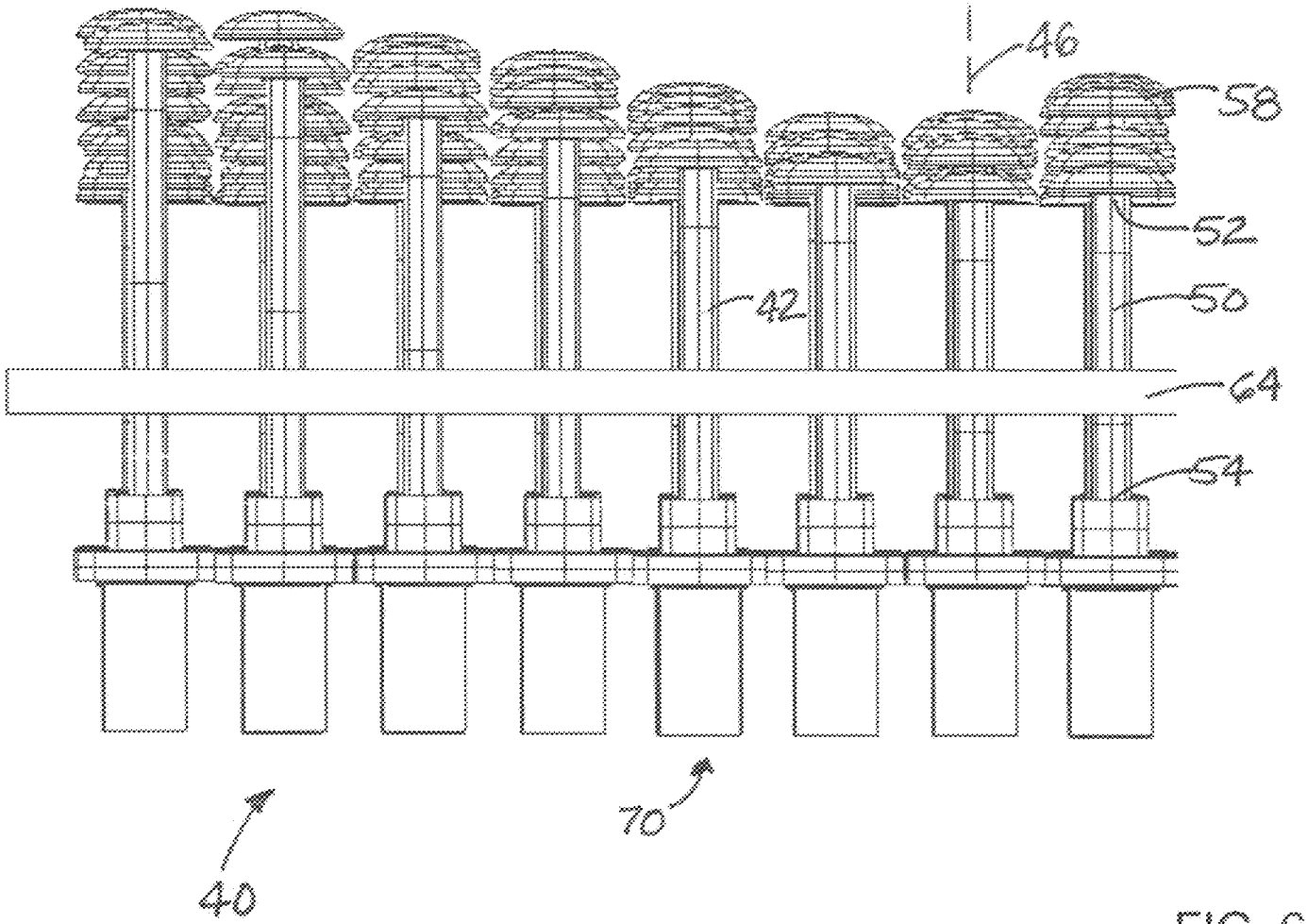
FIG. 6 is a schematic side view of the support assembly with the covering removed to show detail of the support assembly in the raised position.
Figure 7:
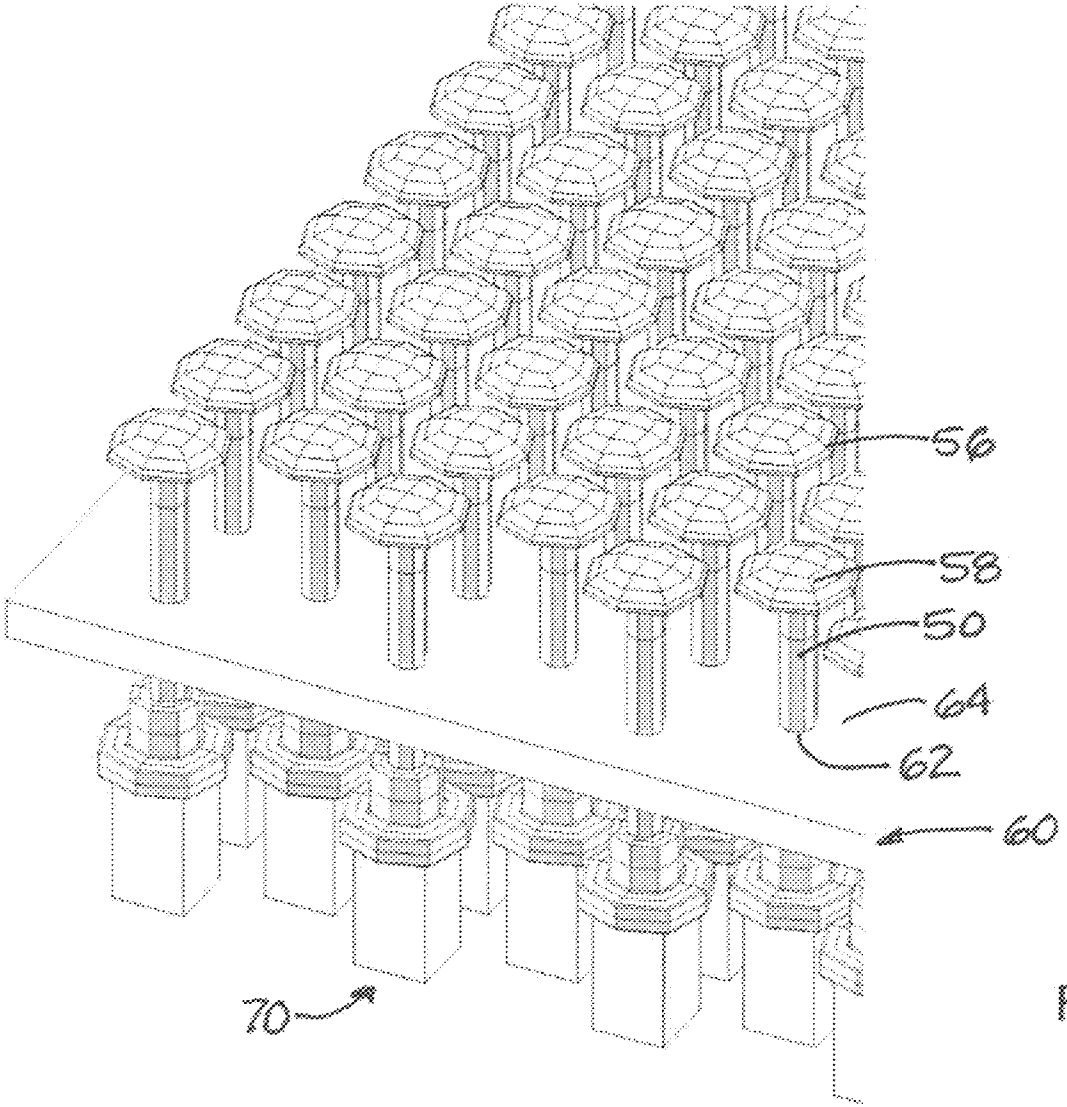
FIG. 7 is a schematic perspective view of the support assembly with the covering removed to show detail of the support assembly with the positioning elements in an optional arrangement.
Figure 8:
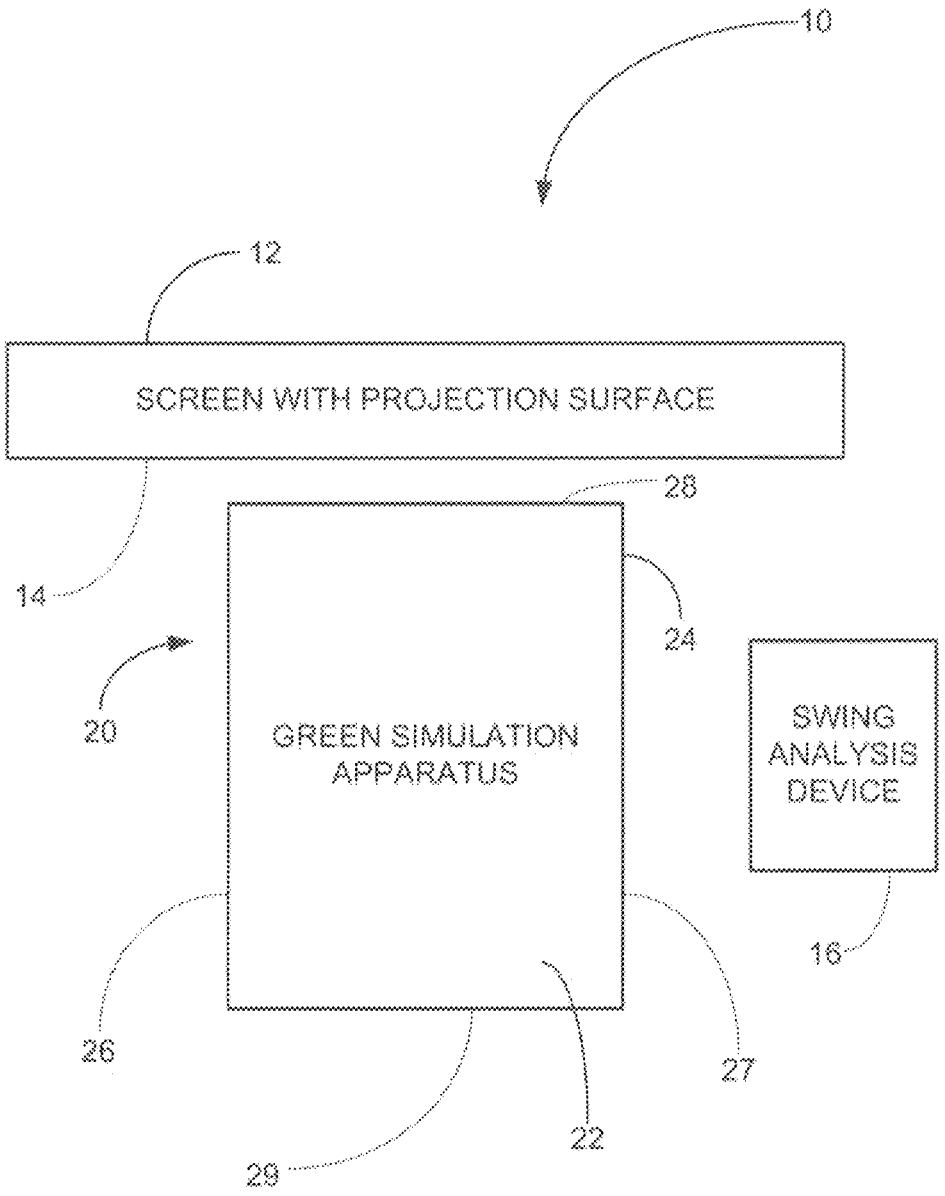
FIG. 8 is a schematic diagram of the golf simulation system, according to an illustrative embodiment.

In some embodiments, the covering 30 may include only a single layer of material. In other embodiments, such as is shown in FIGS. 1 and 2, and particularly in FIG. 33, the covering may comprise at least two layers 150, 152 which may be stacked upon each other, with at least some of the layers being formed by a continuous membrane. In some of the embodiments, at least two of the layers have different thicknesses, and at least one layer with a relatively thinner thickness may be positioned relatively closer to the top face of the covering, and at least one layer with a relatively thicker thickness may be positioned relatively closer to the bottom face of the covering. In some embodiments, at least two of the layers of the multiple layers may have different flexibility characteristics, although in some embodiments all of the layers may have similar flexibility characteristics. It will be recognized that a difference in flexibility characteristic may be a result of the use of different materials with different characteristics for the different layers, but also may be a result of the layers having different thicknesses, with the thicker layers being generally less flexible than thinner layers of the same material. Further, a substance may be positioned between the faces of the stacked layers in order to facilitate the slippage of the face of one layer with respect to the opposing face of an adjacent layer. In one illustrative implementation, a dry powder such as talc (e.g., hydrated magnesium silicate) may be utilized to facilitate the slippage of one layer with respect to the adjacent layer.

The array of positioning elements 42 in the covering support assembly 40 may include positioning elements positioned in a central region 154 and positioning elements located in at least one peripheral region 156. The respective regions are oriented with respect to each other in a substantially horizontal direction, and may support corresponding regions of the covering 30. In some embodiments, a pair of the peripheral regions 156 and 157 may be utilized, and the peripheral regions 156, 157 may be located on substantially opposite sides of the central region 154. The central region 154 may include a hole or a hole region. The central region 154 may be elongated and extend between a front 158 of the array of positioning elements to a rear 159 of the array. For the purposes of this description, the rear 159 of the array may be located relatively closer to the screen 12 in systems 10 that include a screen 12, and the hole or hole region may be located towards the rear 159, while the front 158 may be located relatively opposite of the rear 159 and may be relatively further away from the screen 12 and may be located closer to where a user stands when utilizing the apparatus. The peripheral regions 156, 157 may extend generally between the front 158 and the rear 159 of the array in locations lateral to the central region 154.

Figure 34:
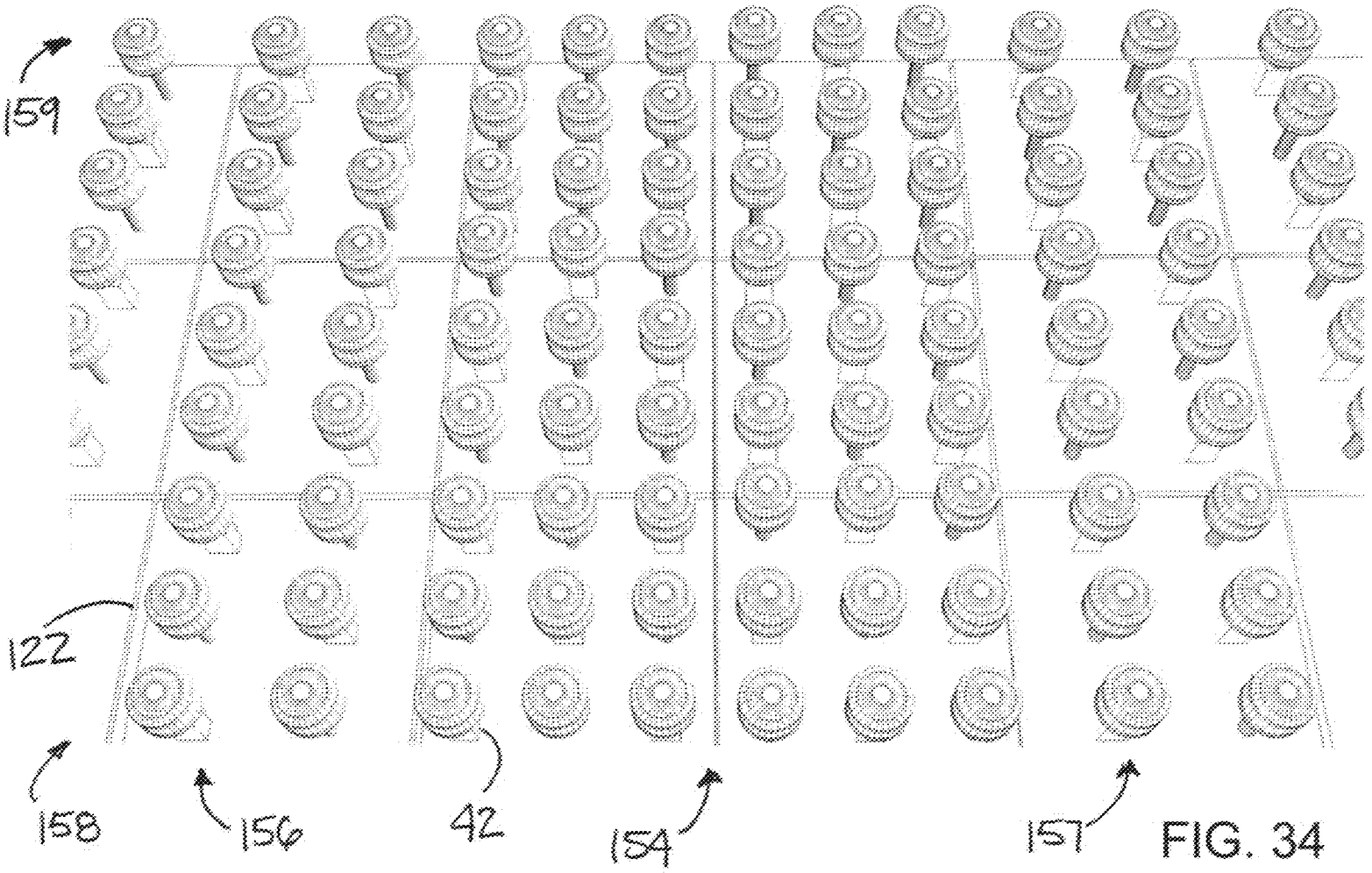
FIG. 34 is a schematic perspective view of an illustrative embodiment of the green simulation apparatus with the covering removed to show the plurality of positioning elements in an arrangement having a varying density.
Figure 35:
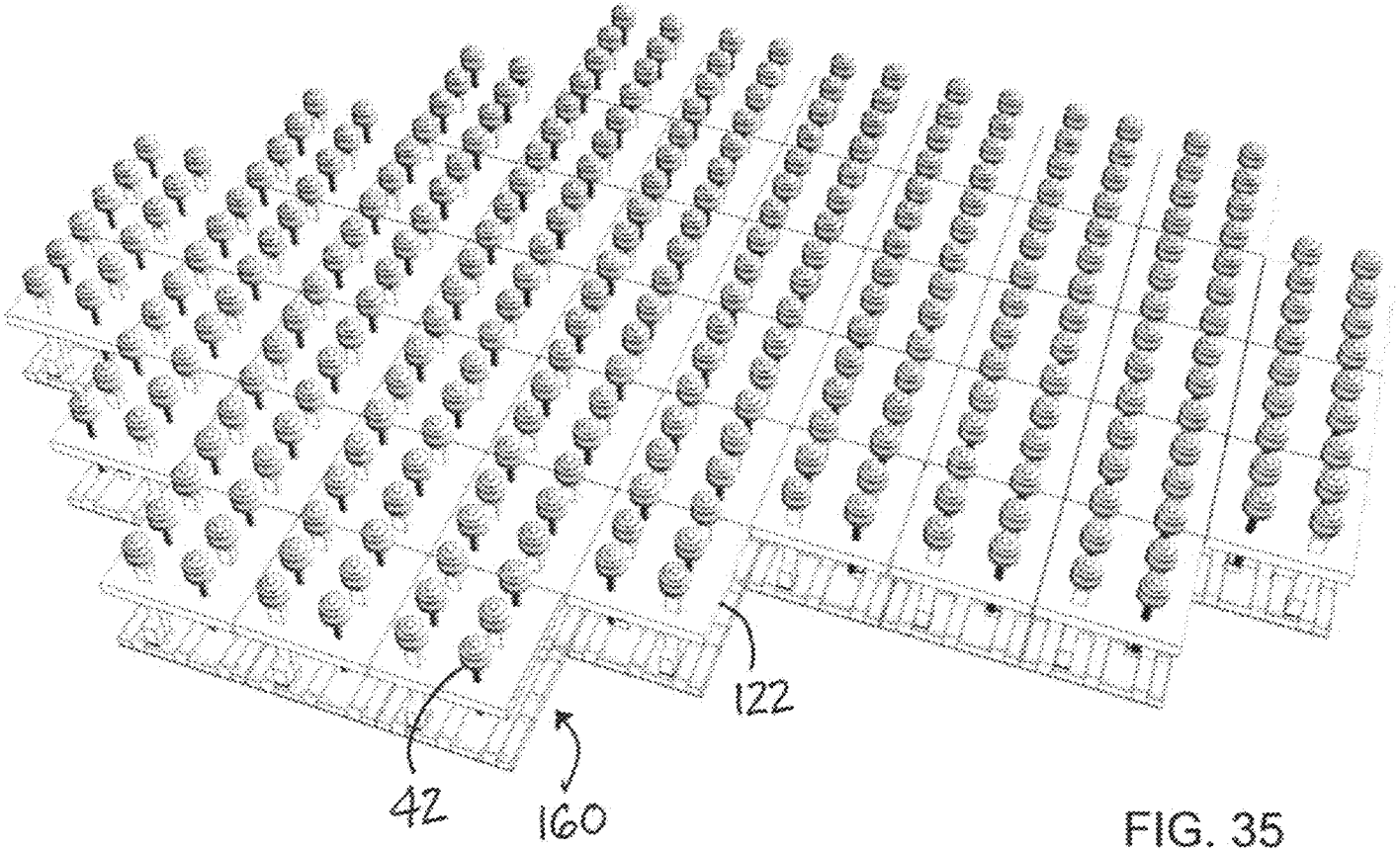
FIG. 35 is a schematic perspective view of an illustrative embodiment of the green simulation apparatus with the covering removed in which an array of modules of the positioning elements is arranged with irregular outer perimeter of the apparatus.
Figure 36:
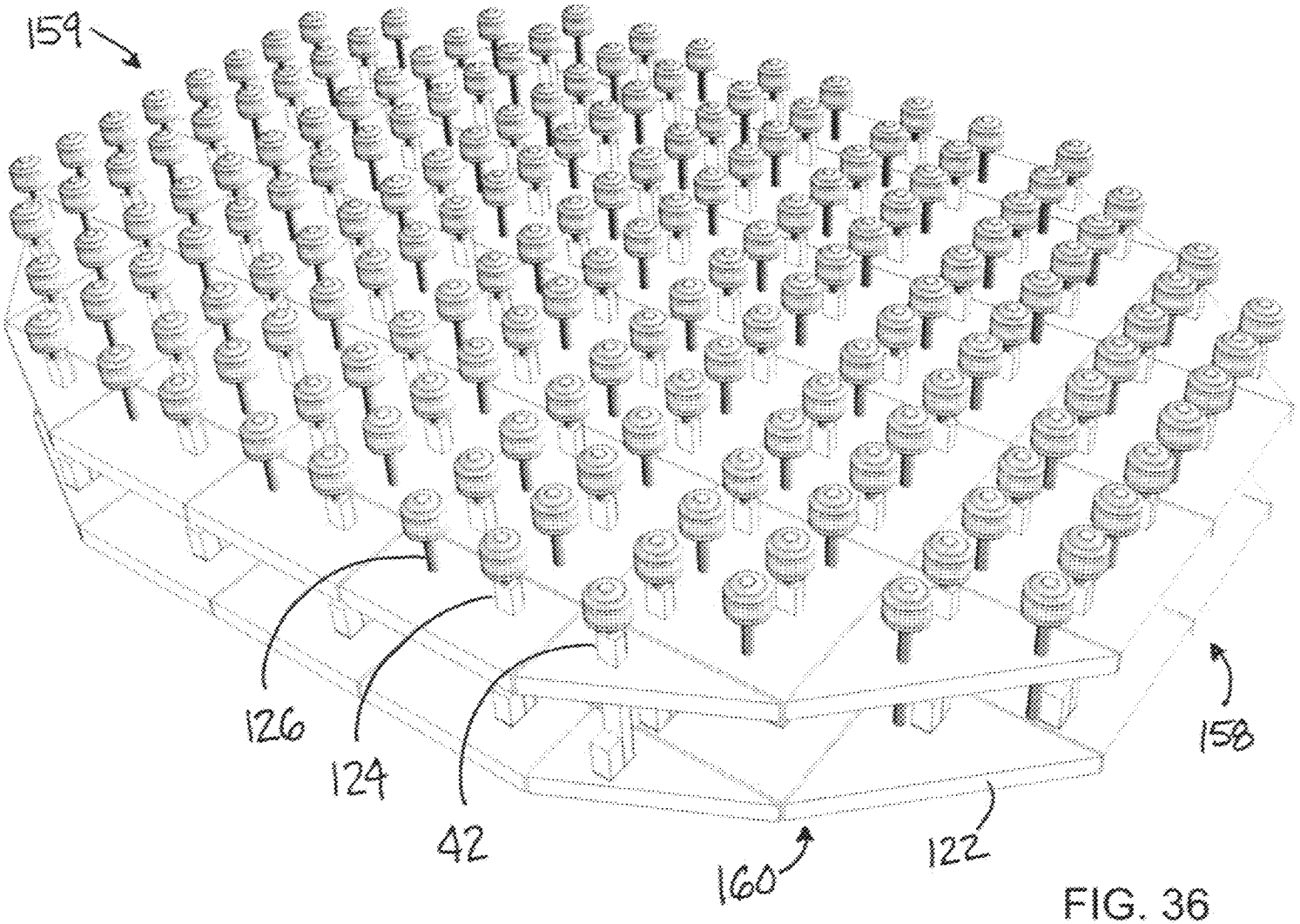
FIG. 36 is a schematic perspective view of an illustrative embodiment of the green simulation apparatus with the covering removed in which an array of modules of the positioning elements are arranged with smaller and/or irregularly shaped modules are positioned along the outer perimeter of the apparatus.
Figure 37:
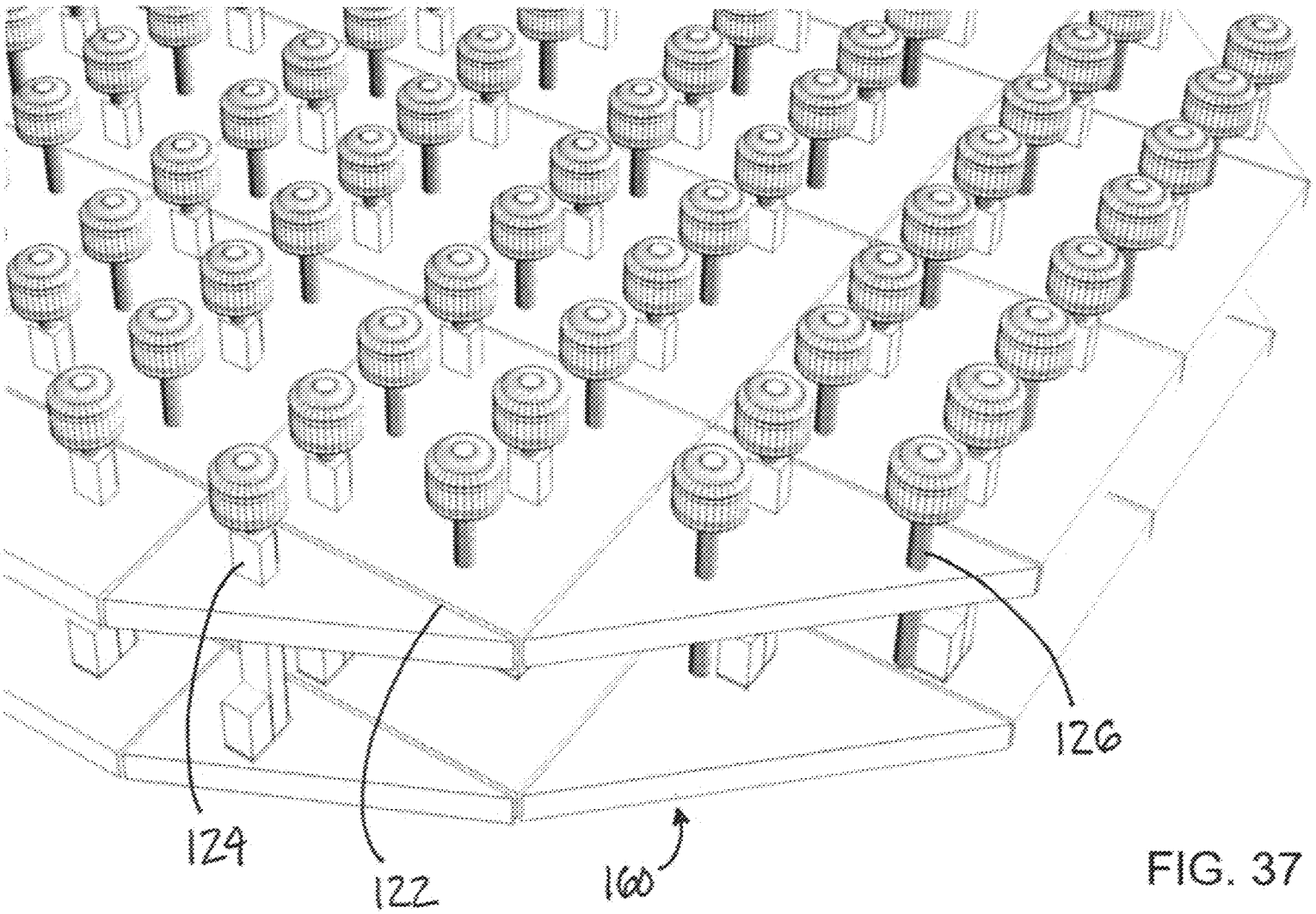
FIG. 37 is a schematic perspective view of an enlarged portion of the embodiment of the green simulation apparatus of FIG. 36.
Figure 38:
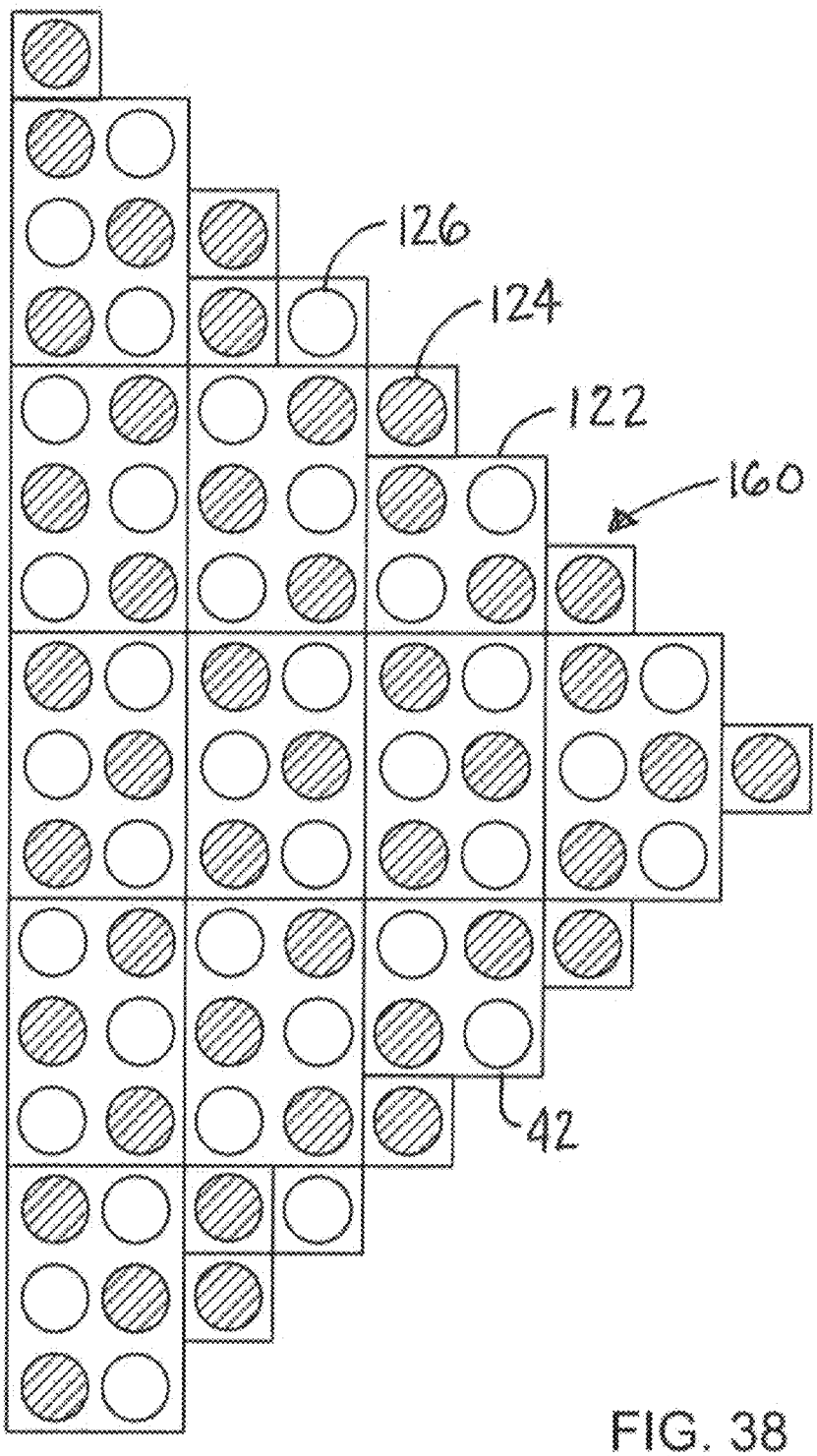
FIG. 38 is a schematic top diagrammatic view of an array of modules with positioning elements having modules with different sizes and irregular shapes and showing an illustrative pattern of active and passive positioning elements, according to an illustrative embodiment.
Figure 39:
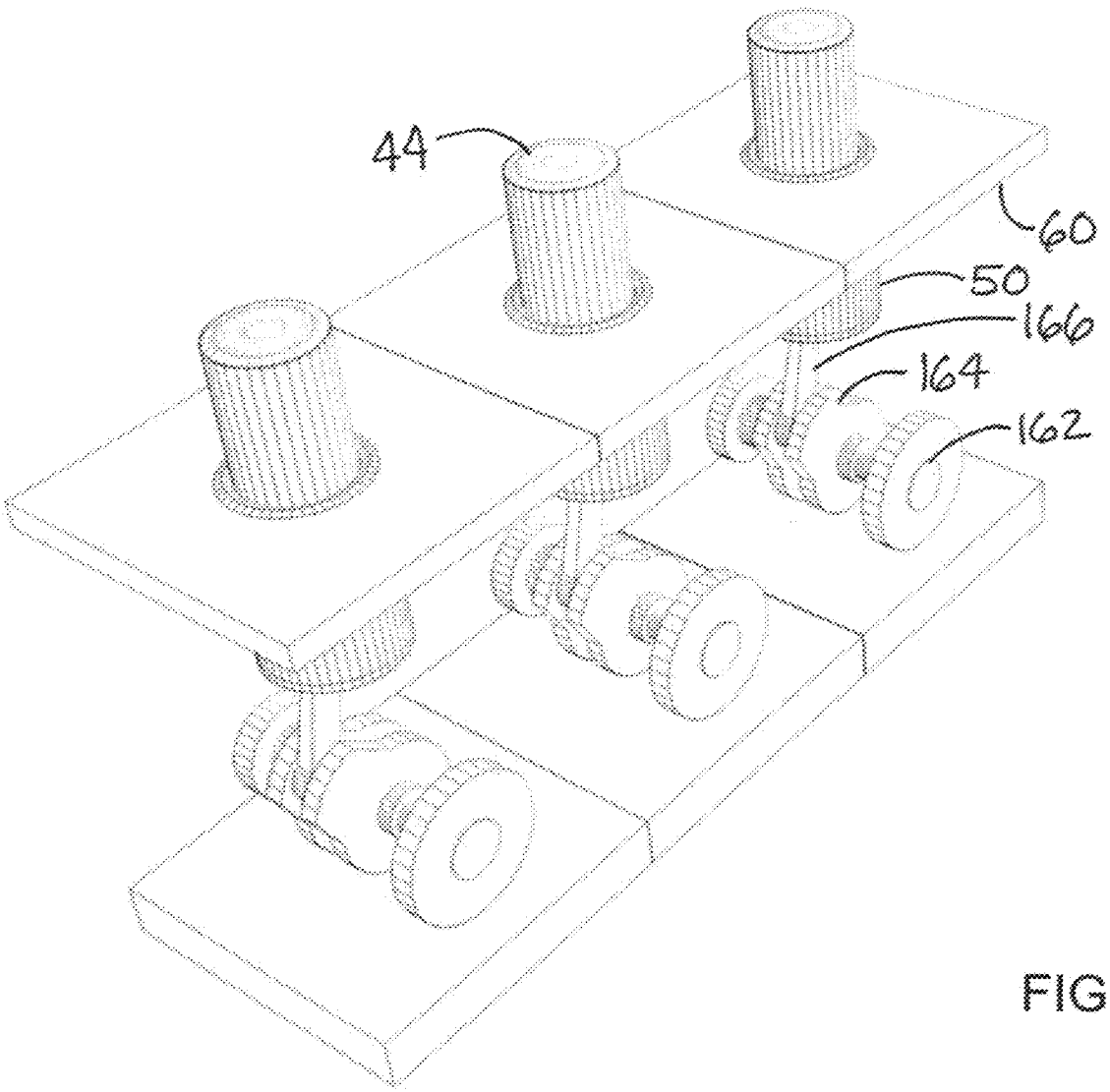
FIG. 39 is a schematic perspective view of an optional embodiment of the positioning elements of the covering support assembly, according to an illustrative embodiment.

In some embodiments, a variation in the spacing between adjacent positioning elements in the array may be employed to produce a variation in the density of the positioning elements (see, e.g., FIG. 34). Illustratively, a positioning element 42 may be located at a spacing distance from an adjacent positioning element 42. The spacing distance between a pair of adjacent positioning elements in one region may be different than the spacing distance between a pair of positioning elements in another region. As a result, regions of the array in which the spacing distance is relatively greater will have a lesser density of positioning elements and regions in which the spacing distance is relatively smaller will have a higher density of positioning elements. Regions in which greater control of the upper surface contouring may have a relatively greater density of elements 42, while regions in which lesser control of the upper surface contouring is needed may employ a relatively lesser density of the elements 42. In some embodiments, the relative density of positioning elements in the array may be relatively greater or denser in the central region 154 than the density of positioning elements in the peripheral region or regions.

The array of positioning elements may have an outer perimeter 160 which may be located relatively adjacent to the periphery 24 of the upper surface of the apparatus. In some embodiments, the outer perimeter of the array may be relatively rectangular in shape, although in other embodiments the outer perimeter may be non-rectangular, or irregular, in shape (see, e.g., FIGS. 35 through 38). Portions of the outer perimeter 160 may be formed by modules having different arrangements of positioning elements, including different numbers of positioning elements. The peripheral modules may include different numbers of active and passive positioning elements and different patterns of active and passive positioning elements.

An optional embodiment of the movement actuator 70 (see, e.g., FIG. 39) may comprise a rotary shaft 162 that may extend in a direction oriented substantially perpendicular to a longitudinal axis and associated positioning element. In some embodiments, the rotary shaft 162 may generally extend in a horizontal plane. The rotary shaft may include an offset section 164 which is generally offset from a longitudinal axis of the rotary shaft about which the shaft rotates. The movement actuator may further include a connecting element 166 which connects the offset section 164 of the rotary shaft to the pin 50 of the associated positioning element such that rotation of the rotary shaft moves the pin in a vertical direction by virtue of the eccentric motion of the offset section of the rotary shaft.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A green simulation apparatus having a configurable upper surface with a changeable contour, the apparatus comprising:

a covering forming the upper surface;

a covering support assembly configured to support the covering, the support assembly comprising:

a plurality of movable positioning elements having the covering resting thereon, the plurality of positioning elements being positioned in an array extending in a reference plane, the positioning elements being movable along axes extending substantially perpendicular to the reference plane, the positioning elements being elongated with a longitudinal axis; and a movement actuator configured to move at least one of the positioning elements independently of other positioning elements in the array;

wherein the plurality of positioning elements includes active positioning elements and permanently passive positioning elements, the active positioning elements being associated with said movement actuator and the passive positioning elements not being associated with said movement actuator, whereby the movement actuator does not directly move the permanently passive positioning elements;

the permanently passive positioning elements being attached to the covering whereby movement of the covering by the active positioning elements causes movement of the passive positioning elements and movement of the passive positioning elements occurs only in response to movement of the covering by the active positioning elements.

2. The apparatus of claim 1 wherein passive movement elements are positioned between active movement elements in the array of movement elements.

3. The apparatus of claim 1 wherein passive movement elements and active movement elements are alternately positioned in the array of movement elements.

4. The apparatus of claim 1 wherein the positioning elements each have a neutral position in which an upper end of the positioning element is located in the reference plane, at least some of the positioning elements each being movable upwardly from a neutral position to a plurality of raised positions in which the upper end is located at a plurality of different distances above the neutral position in the reference plane.

5. A green simulation apparatus having a configurable upper surface with a changeable contour, the apparatus comprising:

a covering forming the upper surface;

a covering support assembly configured to support the covering, the support assembly comprising:

a plurality of movable positioning elements having the covering resting thereon, the plurality of positioning elements being positioned in an array extending in a reference plane, the positioning elements being movable along axes extending substantially perpendicular to the reference plane, the positioning elements being elongated with a longitudinal axis; and a movement actuator configured to move at least one of the positioning elements independently of other positioning elements in the array;

wherein the plurality of positioning elements includes active positioning elements and passive positioning elements, the active positioning elements being associated with said movement actuator and the passive positioning elements not being associated with said movement actuator; and the covering support assembly additionally comprises a locking assembly for selectively locking at least one of the positioning elements in a selected movement position.

6. The apparatus of claim 5 wherein the locking assembly is configured to act on at least one passive movement element of the array of movement elements.

7. The apparatus of claim 5 wherein at least one of the positioning elements includes a pin having an exterior surface, a plurality of recesses being formed on the exterior surface of the pin along at least a portion of a length of the pin, and the locking assembly comprises a lock element actuatable to engage at least one of the recesses formed on the at least one positioning element.

8. The apparatus of claim 7 wherein the at least one positioning element is said passive positioning element.

9. The apparatus of claim 7 wherein the lock element comprises a lock plate with an aperture through which the pin of the at least one positioning element extends.

10. The apparatus of claim 9 wherein the locking plate is movable to position a portion of the locking plate in one of the recesses formed in the pin of the at least one positioning element.

11. The apparatus of claim 10 additionally comprising a guide with a guide aperture through which the pin of the at least one positioning element extends, the locking plate being movable with respect to the guide between a lock position and a release position.

12. A green simulation apparatus having a configurable upper surface with a changeable contour, the apparatus comprising:

a covering forming the upper surface;

a covering support assembly configured to support the covering, the support assembly comprising:

a plurality of movable positioning elements having the covering resting thereon, the plurality of positioning elements being positioned in an array extending in a reference plane, the positioning elements being movable along axes extending substantially perpendicular to the reference plane; and at least one movement actuator configured to move at least one of the positioning elements independently of other positioning elements in the array;

wherein the array of positioning elements includes a central region and at least one peripheral region positioned peripheral to the central region, a density of positioning elements in the reference plane being greater in the central region than in the at least one peripheral region.

13. The apparatus of claim 12 wherein a spacing distance between adjacent positioning elements in the central region is smaller than a spacing distance between adjacent positioning elements in the peripheral region.

14. The apparatus of claim 12 wherein the at least one peripheral region comprises a pair of peripheral regions located on substantially opposite sides of the central region.

15. The apparatus of claim 12 wherein modules of the central region have a greater number of positioning elements than modules of the at least one peripheral region.

16. The apparatus of claim 12 wherein the central region extends from a front of the upper surface to a rear of the upper surface.

17. The apparatus of claim 12 wherein the positioning elements each have a neutral position in which an upper end of the positioning element is located in the reference plane, at least some of the positioning elements each being movable upwardly from a neutral position to a plurality of raised positions in which the upper end is located at a plurality of different distances above the neutral position in the reference plane.

* * * * *